US005913732A

United States Patent [19]

Kwakkel

[11] Patent Number: 5,913,732

[45] Date of Patent: Jun. 22, 1999

[54] GOLF PUTTING VERTICAL ALIGNMENT AND TRAINING AID

[76] Inventor: Klaas Kwakkel, 7924-46 Avenue N.W., Calgary, Alberta, Canada, T3B 1Y3

[21] Appl. No.: 09/037,967

[22] Filed: Mar. 11, 1998

Related U.S. Application Data

[60] Provisional application No. 60/041,532, Mar. 21, 1997.

[51] Int. Cl.[6] ..... A63B 69/36

[52] U.S. Cl. ..... 473/267; 473/240; 473/257; 473/409

[58] Field of Search ..... 473/267, 264, 473/257, 260, 240, 409

[56] References Cited

U.S. PATENT DOCUMENTS

| | | | |
|---|---|---|---|
| 3,118,678 | 1/1964 | Rohr | 473/240 |
| 3,604,711 | 9/1971 | Hansburg | 473/257 |
| 3,806,133 | 4/1974 | Cork | 473/258 |
| 3,857,570 | 12/1974 | Gutierrez et al. | 473/264 |
| 3,934,874 | 1/1976 | Henderson | 473/265 |
| 4,082,287 | 4/1978 | Berkey . | |
| 4,315,626 | 2/1982 | Hamm . | |
| 5,209,484 | 5/1993 | Randall . | |
| 5,776,007 | 7/1998 | Kendall et al. | 473/260 X |

*Primary Examiner*—George J. Marlo

[57] ABSTRACT

A golf putting vertical alignment and training aid comprising a reflective material (22) adapted to be positioned remote from a golf ball, a golf putter club, and a golfer standing in a putting position, and comprising an elongated material (30) adapted to be positioned overtop of a target line in a manner such that when viewed from above, the elongated material's longitudinal axis appears to be parallel to the target line (68), the target line being defined by the path that a golfer would like a golf ball to follow, and the elongated material being of a minimum length that extends from the golf ball to the reflective material, and the putting aid comprising a suspending means for positioning the elongated material above the reflecting surface of the reflective material, in a manner such that a reflection (60) of a portion of the elongated material can be seen within the reflecting surface. A golfer can utilize the reflection of the elongated material to position the golfer's eyes substantially vertically overtop of the elongated material. This in turn will assist the golfer in determining a point on the putting surface that is directly below the elongated material. Since the elongated material is set up such that it represents a reference target line from the golf ball to the cup, this invention essentially aids the golfer in positioning his or her eyes substantially vertically overtop of the target line and the golf ball. This can be used to aid the golfer in developing a putting stroke that follows the target line and correctly strikes the ball.

16 Claims, 6 Drawing Sheets

GOLF PUTTING VERTICAL ALIGNMENT AND TRAINING AID

This application claims the benefit of U.S. Provisional Application No. 60/041,532 filed Mar. 21, 1997.

BACKGROUND

1. Background—Field of Invention

This invention relates to golf putting training aids, specifically to devices that are used to help a golfer learn how to position his or her eyes vertically above the golf ball and the target line and to perform a proper and consistent putting stroke.

2. Background—Description of Prior Art

A number of different devices have been invented over the years to assist a golfer in learning how to address the golf ball and perform the putting stroke properly. One of the most important deficiencies in all of these prior inventions, is that they each focused on only a few of the aspects of the putting stroke. This is a major flaw, because for a golfer to be able to learn how to perform an accurate and consistent putting stroke, the golfer needs to be able to take all of the putting aspects into account at the same time.

The golfer first has to learn how to envision where the target line will be, from the golf ball to the cup. The golfer must then learn how to properly address the target line and the golf ball. Once the target line and the golf ball are properly addressed, the golfer must learn how to place his or her eyes vertically overtop of the golf ball and the desired target line. The golfer must then learn how to swing the putter such that the putter head travels exactly along the target line and such that the face of the putter is always kept exactly square to the longitudinal direction of the target line and square to the direction of travel. Once all of these individual steps are learned, the golfer must then learn how to combine them all together, to complete the golf putting stroke. Only then will the golfer learn how to stroke the golf ball properly and consistently, so that the ball travels along the desired target line.

None of the golf putting training aids that have been invented in the past, assist the golfer in learning how to improve all of the above techniques at the same time. For example, U.S. Pat. No. 3,604,711 to Hansburg (1971), shows a device that can be used to establish the target line from the golf ball to the cup, but there is no way for the golfer using this device to accurately position his or her head vertically overtop of the target line and the golf ball. If the golfer's eyes are not positioned exactly overtop of the target line and the golf ball, there will be a tendency to stroke the ball in a direction other than the desired target line. This is because the golfer will imagine a target line that is different from the proper one.

U.S. Pat. No. 3,806,133 to Cork (1974), provides a teaching aid that helps the golfer learn how to strike the golf ball properly when performing the putting stroke. However, as with Hansburg above, there is no means to assist the golfer in first positioning his or her eyes directly overtop of the target line and the golf ball. The golfer would therefore be improperly learning how to stroke the ball because the correct form and positioning has not been taken into account.

U.S. Pat. Nos. 3,857,570 to Gutierrez et al (1974), 3,934,874 to Henderson (1976), 4,082,287 to Berkey (1978), 4,315,626 to Hamm (1982), and 5,209,484 to Randall (1993), all provide means to learn how to perform the putting stroke, but none of these devices help the golfer in learning how to address the proper target line and the golf ball, prior to stroking the golf ball.

The second most important deficiency in all of the prior inventions is that when the devices are used, they all interfere with the golfer's actual putting stroke. Therefore, the teaching aid itself, inhibits the golfer's ability to learn how to improve his or her putting stroke. For example, in U.S. Pat. No. 3,604,711 to Hansburg (1971), the golfer extends a cord or tape on top of the putting surface and along the target line towards the golf cup. This setup will actually interfere with the roll of the golf ball and cause it to deflect away from its path. This means the golfer would not be able to receive positive feedback as to whether the ball was struck properly in the first place. It is also evident that the cord or tape will interfere with the stroke of the putter. This is because the putter would be travelling overtop of two different surfaces: the grassy surface of the green, and the artificial surface of the cord or tape. This could cause the golfer to learn a different stroke as compared to when the tape or cord is removed.

U.S. Pat. Nos. 3,806,133 to Cork (1974), 3,857,570 to Gutierrez et al (1974), 3,934,874 to Henderson (1976), 4,082,287 to Berkey (1978), 4,315,626 to Hamm (1982), and 5,209,484 to Randall (1993), all involve mechanical frames or apparatuses that interfere and restrict the movement of the putter head. This is detrimental because it does not allow the golfer to naturally develop his or her putting stroke. It is comparable to the use of a crutch; a person can learn how to walk with a crutch, but as soon as the crutch is removed, the person must again learn how to walk, this time without the crutch.

Some of the prior mechanical frames or apparatuses, such as U.S. Pat. Nos. 3,806,133 to Cork (1974), 3,857,570 to Gutierrez et al (1974), 3,934,874 to Henderson (1976), and 5,209,484 to Randall (1993), result in severe limitations to the movement of the putter. U.S. Pat. Nos. 4,082,287 to Berkey (1978) and 4,315,626 to Hamm (1982), are perhaps not as restricting, but they still result in distracting the golfer from learning how to perform the putting stroke. This is because it is difficult to practice the putting stroke without constantly having the eyes focus on the mechanical apparatus.

A third deficiency with most of the prior putting-aid inventions, is that they involve complicated and cumbersome designs. For example, U.S. Pat. Nos. 3,806,133 to Cork (1974), 3,857,570 to Gutierrez et al (1974), 3,934,874 to Henderson (1976), 4,082,287 to Berkey (1978), and 5,209,484 to Randall (1993), show mechanical apparatuses that are difficult to transport and store in the golfer's golf bag. U.S. Pat. No. 3,806,133 to Cork (1974) in particular, is an example of an apparatus that is not very portable. It involves a special golf club that has an opening through its shaft, and a pair of rods and other mechanical members, all of which would have to be transported with the golfer. U.S. Pat. No. 5,209,484 to Randall (1993), is an example of a putting aid that is overly complicated. It contains a number of clips and locating beads that are moved in different ways when setting up the assembly.

A fourth deficiency of all of the prior golf putting aids, is that none of them permit the incorporation of instructor feedback. That is, when using the prior inventions, an instructor who may be assisting the golfer, is not able to determine whether the golfer is performing all of the golf putting steps correctly. For example, if a golfer was using any one of U.S. Pat. Nos. 3,604,711 to Hansburg (1971), 3,806,133 to Cork (1974), 3,857,570 to Gutierrez et al (1974), 3,934,874 to Henderson (1976), 4,082,287 to Berkey (1978), 4,315,626 to Hamm (1982), or 5,209,484 to Randall (1993), the instructor would not be able to determine whether the golfer has placed his or her eyes exactly overtop of the target line.

The last deficiency and probably the most important in regard to prior golf putting aids, is that many of them do not actually help the golfer to achieve proficiency in the particular area that is intended by the invention. For example, U.S. Pat. No. 3,604,711 to Hansburg (1971), is intended to help the golfer strike a golf ball such that the golf ball travels down the exact target line from the golf ball to the cup. The first problem with this invention however, is that there is no way for the golfer to accurately determine whether his or her eyes are exactly vertically overtop of the target line and the golf ball. In fact, when standing square to the target line, the golfer's eyes could actually be a distance forward or backwards from the target line, in relation to the direction that the golfer is facing. If the golfer's eyes are not exactly overtop of the target line, it will cause the golfer to imagine a target line that is different from the one that is actually desired.

The second problem with U.S. Pat. No. 3,604,711 to Hansburg (1971), is that it does not help the golfer to learn how to strike the ball correctly, so that the ball travels along the target line. This is because the cord or tape that is extended on top of the putting surface and along the target line, actually interferes with the roll of the ball. The tape or cord cause the ball to go off target and the golfer is therefore not able to get positive feedback on whether the putting stroke was performed properly in the first place.

U.S. Pat. No. 3,806,133 to Cork (1974), shows an apparatus that can be used to learn how to stroke the golf ball properly. But in fact, this design could actually teach the golfer to have an improper putting stroke because there is no consideration given to first positioning the golfer's eyes properly. The golfer's eyes must first be positioned such that they are vertically above the target line and the golf ball before attempting to perform the putting stroke.

U.S. Pat. Nos. 3,857,570 to Gutierrez et al (1974), 4,315,626 to Hamm (1982), and 5,209,484 to Randall (1993), all provide an elongated member such as a cord or a metal bar, that is positioned above the putting surface and pointed in the direction of the target line. The intent is that the cord or metal bar is to be used to help the golfer learn how to position his or her eyes vertically overtop of the golf ball. The problem with this type of design is similar to that mentioned above for the Hansburg invention. Even though the elongated member is above the golf ball, there is no way to accurately determine whether the golfer's eyes are exactly vertically overtop of the target line and the golf ball. As stated above, when the golfer is standing square to the target line, the golfer's eyes could actually be a distance forward or backwards from the target line, in relation to the direction that the golfer is facing. The golfer's eyes must be positioned exactly overtop of the target line and the golf ball, for the golfer to be able to envision the correct line of travel of the golf ball.

U.S. Pat. Nos. 3,934,874 to Henderson (1976) and 4,082,287 to Berkey (1978), both provide designs that do assist a golfer in learning to position his or her eyes vertically overtop of a golf ball that is placed within the mechanical device. However, there is no way for the golfer to first determine whether the training apparatus is on a horizontal putting surface. If these inventions are not first placed on a horizontal putting surface, they will not work properly to help the golfer position his or her eyes vertically overtop of the golf ball. Consequently, the result will be the same as in the Hansburg, Gutierrez, Hamm, and Randall inventions. The golfer will envision the wrong target line and will perform an incorrect putting stroke.

OBJECTS AND ADVANTAGES

My invention has numerous objects and advantages, most of which are not present in the prior art:

(a) With the assistance of my invention, a golfer can learn how to accurately and consistently place his or her eyes vertically overtop of the target line and the golf ball;

(b) With the addition of a levelling means, as shown in the preferred embodiment, my invention can be set up on any putting surface, regardless of the slope or orientation;

(c) With my invention, the golf ball can be placed on the actual surface that the golfer wishes to practice putting on;

(d) When my invention is used to properly strike the golf ball, the ball continues to travel on the desired putting surface, without any interference from any of the components of the invention;

(e) With my invention, the golfer is able to perform a smooth natural putting stroke, that is unrestricted by any of the components of the invention;

(f) Before the golfer even begins to practice the putting stroke, he or she can first set up my invention so that the elongated material presents an accurate reference target line from the golf ball to the cup;

(g) The reference target line that is presented by my invention, is positioned above the actual putting surface so that it does not interfere with the golfer's stroke or the roll of the golf ball;

(h) With the assistance of the levelling device that has been incorporated into my invention, the invention can be used on any putting surface, regardless of the orientation of such surface;

(i) The elongated material of my invention that is used as the reference target line, can be made of a very small-diameter material which does not cause any distraction to the golfer when using the invention;

(j) My invention can be made of small, light, and inexpensive materials that are easy to manufacture and which can be transported in the golfer's bag without any inconvenience;

(k) My invention is easy to assemble and disassemble, and takes up minimal storage space;

(l) With my invention, a golf instructor can also use the vertical-aligning attributes to verify that a golfer has positioned his or her eyes properly overtop of the target line;

(m) When a golfer uses my invention, the components of the invention do not interfere with the golfer's putter or with the golf ball;

(n) With my invention, the golfer can learn how to envision the proper target line from the golf ball to the cup, which in turn will help the golfer to learn how to assume a balanced putting stance that is square to the target line;

(o) With my invention, the golfer has practically an unobstructed view of the golf ball;

(p) With my invention, the golfer can practice putting at different distances from the cup, without having to reposition the invention;

(q) My invention can be used to develop all types of putts, including straight, breaking, uphill, downhill, or any combination of these;

(r) When a golfer uses my invention to practice his or her putting stroke, they are provided with instant feedback on the result of any putt;

(s) My invention can be used to develop all of the individual components of a proper putting stroke, such as addressing the target line and the golf ball, positioning the eyes vertically overtop of the target line and the golf ball, and developing a putting stroke that follows the target line and correctly strikes the ball;

(t) After all of the individual components of a proper putting stroke have been mastered, my invention can be used to combine them all together to develop a putting stroke that takes all of the factors into consideration and helps the golfer to develop an accurate and consistent putt.

Further objects and advantages will become apparent from a consideration of the following description and drawings.

DRAWING FIGS. 1 to 6

REFERENCE NUMERALS IN DRAWINGS

| | | | |
|---|---|---|---|
| 20 | base | 36 | base front side |
| 38 | base back side | 40 | base right side |
| 42 | base left side | 22 | reflective material |
| 24 | leveller | 44 | air bubble |
| 46 | black lines around leveller | 26 | base-end post |
| 34 | cup-end post | 50 | lower end of cup-end post |
| 54 | tiny hole in post | 28 | base-end knob |
| 32 | cup-end knob | 30 | elongated material |
| 60 | reflection of elongated material | 68 | proper target line |
| 52 | putting surface | 56 | golf ball |
| 48 | cup | 58 | golfer |
| 62 | putter | 64 | head of putter |
| 66 | face of putter | 70 | axis "x" |
| 72 | axis "y" | 74 | axis "z" |
| 76 | 1st wrong path | 78 | 2nd wrong path |

SUMMARY

This invention comprises a reflective material that has a reflecting surface, an elongated material, and a suspending means for positioning the elongated material above the reflecting surface in a manner such that a reflection of a portion of the elongated material can be seen within the reflecting surface. The result is that the reflection of the elongated material can be used by a human to position the human's eyes substantially vertically above the elongated material, therefore aiding the human in determining a point on a surface that is directly below the elongated material, regardless of the shape or orientation of the particular surface.

Figure 1:
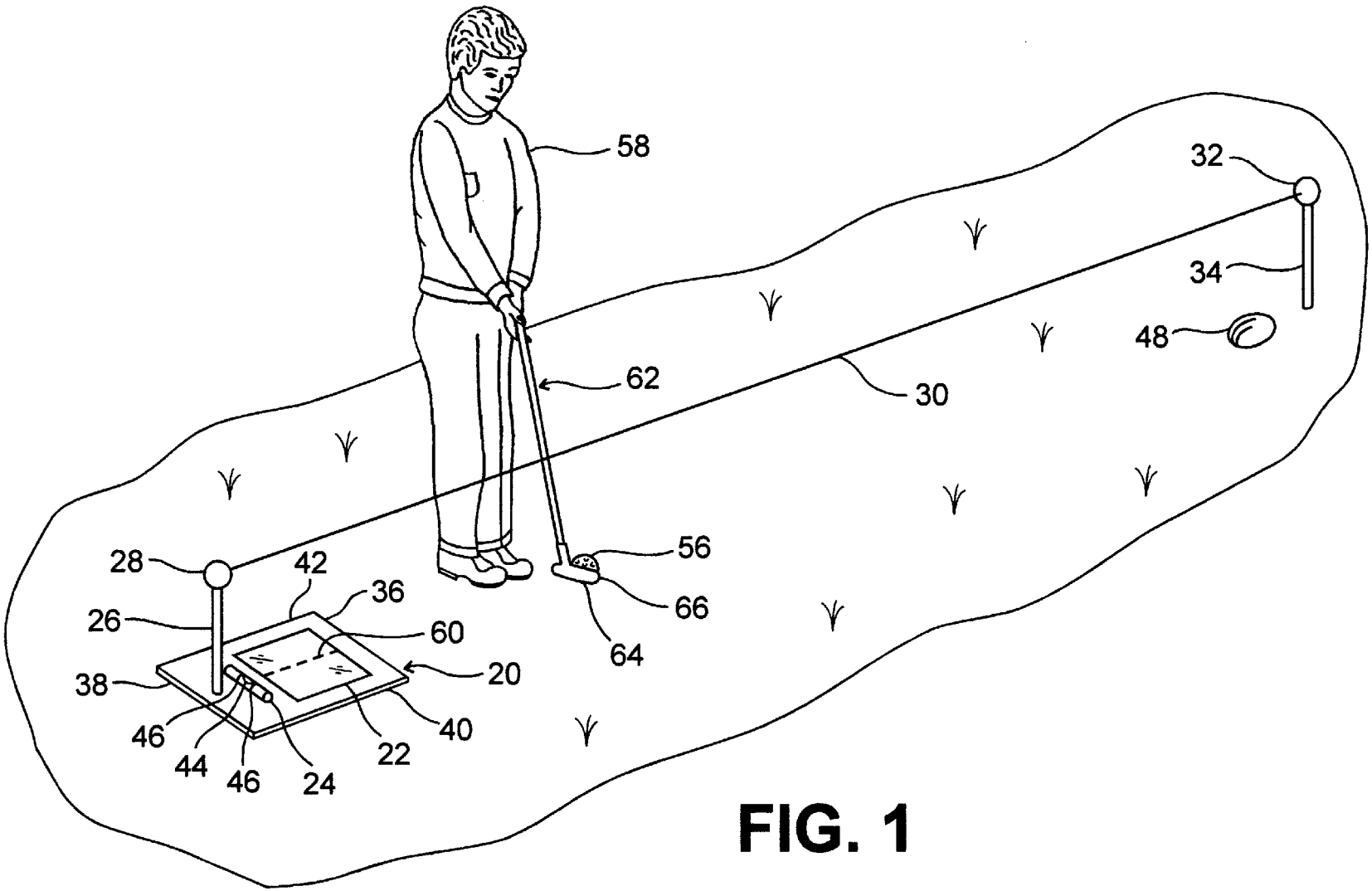
FIG. 1 shows a perspective of the preferred embodiment.
Figure 2:
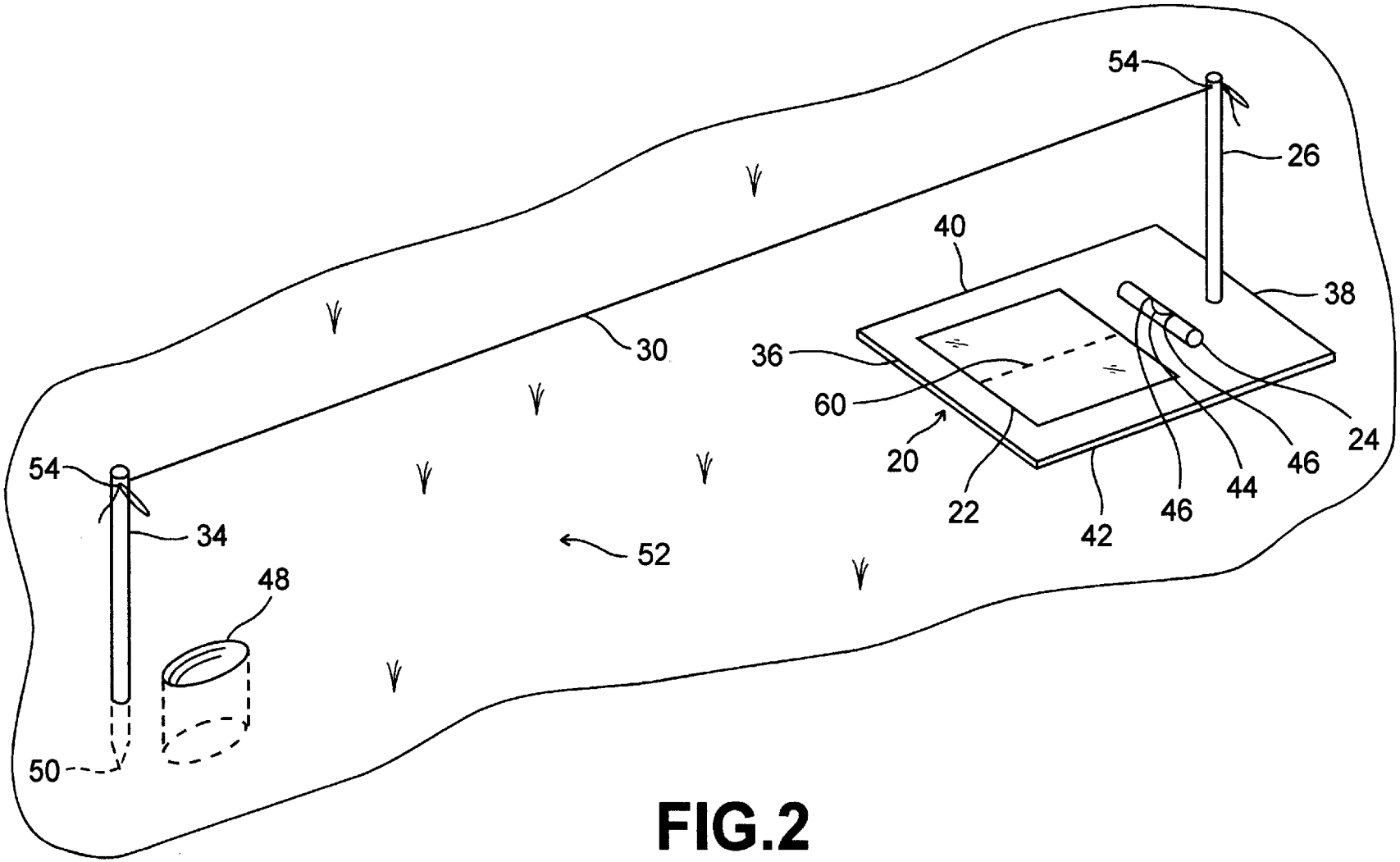
FIG. 2 shows a similar perspective view of an alternate embodiment.

Detailed Description of Invention—FIGS. 1 and 2

Detailed Description of Invention—Introduction—FIGS. 1 and 2

FIGS. 1 and 2 show perspective views of two typical embodiments of my Golf Putting Vertical Alignment and Training Aid. These embodiments have a base 20 of predetermined cross-sectional shape and surface area. Attached to the top of base 20 is a reflective material 22, a leveller 24, and an upright post 26. In FIG. 1, post 26 has a knob or cap 28 attached to the top of it. An elongated material 30 extends from knob 28 to another knob 32 which is attached to the top of a second upright post 34. For ease of reference, post 26 is referred to as the base-end post and post 34 is referred to as the cup-end post.

Detailed Description of Invention—Base Component—FIGS. 1 and 2

As shown in FIGS. 1 and 2, base 20 consists of a front side or edge 36, a back or rear side 38, a right side 40, and a left side 42. Base 20 can be made of any suitable material, such as plastic, wood, or metal, that is sturdy enough to hold the base-end post in place when tension is applied to elongated material 30. Ease of manufacturing and cost would be factors in deciding what type of material to use for the base.

The thickness of base 20 is not a critical factor, as it could be made of different thicknesses depending upon the type of material that is used. Less sturdy material such as plastic, may require the base to be manufactured such that it has a thicker cross section than if it was made of metal for example. In the chosen embodiment, base 20 is made of sturdy plastic that is approximately 2 mms (or 3/32 ins) thick.

In constructing base 20, it is critical that it is made such that when reflective material 22 and leveller 24 are mounted on top of the base, the reflective material and the leveller are both on a substantially horizontal plane. If the leveller and the reflective material are not both on a substantially horizontal plane then the invention will not work properly. This critical factor of the construction is satisfied easiest by making the base of a substantially uniform thickness throughout. Note however, that more complicated designs of the base could be constructed such that the reflective material and the leveller are at different vertical heights, as long as parallel substantially horizontal planes are maintained. For example, reflective material 22 and leveller 24 could be recessed to different depths when being mounted upon base 20.

The size of base 20 is not critical and is basically governed by practicalities. For example, the surface area of the base must be large enough to house the proper size of reflective material 22, along with leveller 24, and post 26. Further, the surface area of the base must be large enough such that the entire base assembly is not pulled over when tension is applied to elongated material 30. On the other hand, if the base is made too large then it will become too cumbersome to transport and use. In a typical embodiment, the base is square and approximately 27 cms×27 cms (or 11 ins×11 ins).

Base 20 can also be rectangular or round or any other shape. However, for practicalities of manufacture and use, it should be made either square or rectangular. For ease of drawing, in each of the Figs. provided the base is shown as being rectangular.

As mentioned above, the base does not have to be constructed so that it is of substantially uniform thickness throughout, as long as the reflective material and the leveller are mounted such that they are on the same or substantially parallel horizontal planes. For example, base 20 could have a raised or thicker back end to better support the base-end pole. This again will depend upon the type of material that is used to construct the base and the thickness of the material. In the FIGS. provided, the base is shown as being of substantially uniform thickness throughout.

Lastly, it is important to note that this invention does not actually require a base at all for it to function properly. The base-end post could be constructed so that it has a slight point at one end, allowing it to be pressed into the putting surface behind the reflective material. The reflective material could then be placed directly upon the putting surface, beneath the elongated material.

The base however, provides a convenient means for holding the base-end post, the reflective material, and the leveller. For this reason, a base is included in the preferred embodiments, as shown in the drawings.

Detailed Description of Invention—Reflective Material—FIGS. 1 and 2

Reflective material 22 (FIGS. 1 and 2) can be any suitable material of substantially uniform cross section that has a planar top reflecting surface area such that a reflection 60 of elongated material 30 can be seen in the reflective material. Examples of suitable material would be a mirror, glass, reflective plastics, and polished metal. An oily fluid in a pan could even be used it the surface of the liquid substance provides a reflection. Note that in this case a substantially uniform cross section would not be required as the surface of the liquid would normally maintain a substantially horizontal orientation. Ease of manufacturing and cost would be factors in deciding what type of material to use for the reflective material. In the chosen embodiment, reflective material 22 is simply a mirror that has been attached to base 20.

The size of the surface area of reflective material 22 is not critical and is basically governed by practicalities. The larger the size of the surface area of the reflective material, the further that a golfer 58 can move away from base 20 while still being able to see reflection 60 of elongated material 30 in the reflective material. However, if the reflective material is made with a surface area that is too large, then the invention will become too cumbersome to transport and use. In a typical embodiment, reflective material 22 has a surface area that is substantially square and is approximately 10 cms×10 cms (or 4 ins×4 ins).

The top surface of reflective material 22 can also be rectangular or round or any other shape. However, for practicalities of manufacture and use, it should be made either square or rectangular. For ease of drawing, in each of the FIGS. provided the surface area of reflective material 22 is shown as being substantially square.

As a type of embodiment not shown, base 20 could itself be constructed of a reflective material such that reflective material 22 shown in FIG. 1 would not be required. For example, the base could be constructed of metal, whereby the top surface is polished to provide mirror-like qualities. In this type of design, the base would then provide a sturdy foundation for post 26 and leveller 24, while at the same time providing reflection 60 of elongated material 30.

The manner in which reflective material 22 is attached to base 20 is not critical, the only requirement being that it be mounted so that it is on the same or a substantially parallel horizontal plane as leveller 24. Therefore, it is easiest to simply use a suitable type of glue to bond the reflective material to base 20.

Detailed Description of Invention—Leveller 24—FIGS. 1 and 2

Leveller 24 (FIGS. 1 and 2) is simply a standard levelling device of a type that is attached to many carpenter's woodworking tools, such as a "level", to aid the carpenter in assembling his boards horizontally. The leveller consists of a small hollow tube or capsule composed of a transparent material such as glass or plastic. The tube is partially filled with a colored liquid (approximately ⅚ths full) such that an air bubble 44 can be seen when the tube is placed on its side. Two black lines 46 are drawn around the side of the tube, which divide the tube into equal thirds.

As shown in FIGS. 1 and 2, leveller 24 is placed on its side when mounted on base 20. As stated above, it is critical that the leveller be attached to base 20 such that the leveller and reflective material 22 are both on either the same horizontal plane or on substantially parallel horizontal planes.

Leveller 24 is mounted on base 20, between reflective material 22 and post 26. As may be seen in FIGS. 1 and 2, the leveller is positioned on the base, such that the longitudinal axis of the leveller is substantially parallel to an axis represented by back side 38 of the base. The leveller is also positioned so that it is approximately in the middle of the base between right side 40 of the base, and left side 42 of the base. Therefore, an imaginary line that runs from front side 36 of the base to back side 38 of the base, cutting the base approximately in halves, would also cut the leveller substantially in half longitudinally.

Note that leveller 24 could actually be positioned anywhere on the base, as long as it is positioned such that its longitudinal axis is substantially parallel with back side 38 of the base. For ease of design and use however, the leveller has been positioned between the reflective material and the base-end post in the chosen embodiment, as described above.

The manner in which leveller 24 is attached to base 20 is not critical and therefore, it is easiest to simply use a suitable type of glue to bond the leveller to base 20. In an alternative embodiment, the leveller could even be glued directly upon the surface of reflective material 22. This would ensure that the leveller and the reflective material are substantially on the same horizontal plane.

Detailed Description of Invention—Posts—FIGS. 1 and 2

Base-end post 26 and cup-end post 34 (FIGS. 1 and 2) can be made of any suitable material, such as plastic, wood, or metal, that is sturdy enough such that the posts stay upright when tension is applied to elongated material 30. Ease of manufacturing and cost are factors in deciding what type of material to use for the upright posts.

The diameters of post 26 and post 34 are also not a critical factor, as such diameters could vary depending upon the type of material that is used. Less sturdy material such as plastic, may require the upright posts to be manufactured with a larger diameter than if they were made of metal for example.

It is not necessary that the upright posts be cylindrical. Their cross section could be square or rectangular or any other shape. It is not even necessary that the posts be vertical in relation to the horizontal plane of the base, as the invention will still work even if the posts are leaning in some direction away from the vertical. The only purpose of the posts is to hold elongated material 30 at a suitable height above putting surface 52 (and above reflective material 22 and leveller 24), while applying a certain amount of tension to the elongated material. In doing this, the only requirement is that elongated material 30 passes over reflective material 22 and leveller 24 in a longitudinal direction that is transverse to the longitudinal axis of leveller 24.

Therefore, in alternative embodiments, elongated material 30 could be held up by curved posts. More than one post could even be used at each end. For example, two posts could be attached to the corners of back-side 38 of the base, at an angle leaning towards each other and meeting approximately in the middle of the base. In this way the longitudinal lines of the posts and the back-side edge of the base, would form a triangle when viewing the posts and the base from the back-side of the base (not shown in the FIGS.). The elongated material could then be attached to the two posts where they meet above the base.

There are actually innumerable embodiments for the design of the suspending means and in fact such suspending means does not require any posts at all. The elongated material could be held up by building blocks. Or, the ends of the elongated material could even be attached to trees or shrubs that are located on the putting surface. None of these designs have been shown in the drawings as they are regarded as minor variations of my invention. The preferred design of the suspending means is to have a post at each end of the elongated material and this is what has been shown in the drawings.

In the chosen embodiment, single upright posts 26 & 34 are used at each end of the invention, as shown in FIGS. 1 and 2. Post 26 and post 34 are made of wood in the approximate shape of a cylinder, with a diameter of approximately 1 cm (or 0.5 ins).

The heights of post 26 and post 34 are dependant upon the desired height of elongated material 30 above the putting surface. The height of the elongated material in turn, is determined by practicalities. The elongated material must be high enough off of putting surface 52 so that it does not interfere with golf ball 56, putter 62, or the putting back swing, stroke, and follow through. On the other hand, the elongated material must not be set too high or it becomes difficult to see reflection 60 of the elongated material in reflective material 22. In addition, as the elongated material is set higher, the posts must be increased in length which in turn requires the base to be made larger in order to stabilize the whole setup. This decreases the portability of the invention and increases the cost.

The optimum height of elongated material 30 is between approximately 10 cms (or 4 ins) and 30 cms (or 12 ins). In the preferred embodiment, elongated material 30 is set at approximately 20 cms (or 8 ins) above the putting surface. Therefore, post 26 and post 34 are constructed to be approximately 20 cms (or 8 ins) in length.

As shown in FIGS. 1 and 2, base-end post 26 is mounted on the top surface of base 20, close to back side 38 of the base and behind leveller 24. In order to assist in accurately setting up elongated material 30 so that its longitudinal direction is substantially transverse to the longitudinal axis of leveller 24, base-end post 26 is positioned so that it is approximately along an imaginary centre line of the base that would run from front side 36 of the base to back side 38 of the base. Therefore, the base-end post will also be positioned approximately in the middle of leveller 24, in relation to the leveller's length.

The manner in which base-end post 26 is attached to base 20 is not critical, the only requirement being that it be mounted rigidly enough so that it will stay in place when an amount of tension is applied to elongated material 30. Therefore, it is easiest to simply drill a hole in base 20 and then press fit the base-end post into the base. For further stability, the base-end post could at the same time be glued so that it is held securely to the base. This alternative embodiment however, would reduce the portability of the invention.

If the posts were made of metal or plastic, then the base-end post could also be threaded at one end, and then screwed into the base for a secure fit, while still maintaining portability.

In the chosen embodiment, as may be seen in FIGS. 1 and 2, the base-end post is simply press fitted into a snug hole that has been drilled through base 20.

Cup-end post 34 on the other hand, is simply pushed directly into the putting surface behind the cup. As may be seen in FIG. 2, this is best accomplished by constructing post 34 so that its lower end 50 is pointed or slightly pointed, to enable it to be pushed by hand into the putting surface. If the cup-end post is constructed with a point or a slight point, then it will need to be made slightly longer than the base-end post, in order to maintain elongated material 30 at approximately the same height above the ground at each end. Note however, that this is not a critical factor, as the invention will work fine even though the elongated material is at different heights at each end.

As an alternative embodiment, base-end post 26 could also be made with a slight point at one end, so that it could be pressed into the putting surface behind base 20. In other words, the base-end post does not have to be attached to the base for the invention to work properly. As stated above, the only requirement is that elongated material 30 passes directly overtop of reflective material 22 in a longitudinal direction that is substantially transverse to the longitudinal axis of leveller 24.

In the chosen embodiment, as may be seen in FIGS. 1 and 2, the base-end post is attached directly to the base for ease of setup.

Detailed Description of Invention—Knobs—FIGS. 1 and 2

Elongated material 30 can be attached to posts 26 & 34 by any number of means. In FIG. 1, the ends of the elongated material are first attached to base-end knob 28 and cup-end knob 32. The elongated material is secured inside of the knobs by threading the elongated material through a tiny hole that has been drilled into the knobs and then by tying each end of the elongated material into a knot (not shown) so that the ends do not slip back out through the holes. Alternatively, the ends of the elongated material could have some type of crimp or clip attached so that the ends are not able to slip out of the holes in the knobs.

Knobs 28 & 32 can be constructed of any suitable material such as rubber, plastic, or wood, and they can be of any desired shape, such as round or square. The knobs are either hollow or at least a significant portion of their insides would be drilled out to the size of the diameter of posts 26 & 34. The knobs can then be press fitted onto the tops of the posts. The knobs must be large enough so that they can be securely placed on the top of the posts, such that they will not pull off when tension is applied to elongated material 30. The sole purpose of the knobs is for convenience, to allow the golfer to easily assemble and disassemble the invention.

In alternative embodiments, elongated material 30 could be attached directly to posts 26 & 34, by any number of methods. For example, as shown in FIG. 2, a tiny hole 54 has been drilled through the upper end of the posts, so that each end of the elongated material can be threaded through the respective hole of each post. Each end of the elongated material is then tied into a knot once threaded through the hole. This embodiment allows the posts to be set apart at different distances, depending upon how much of the elongated material is threaded through the posts.

The preferred embodiment for the attachment of elongated material 30 is that shown in FIG. 1. Knobs 28 & 32 are spherical, hollow, and constructed out of plastic. This construction allows the golfer to set up the invention quickly without being burdened by the loose ends of the elongated material.

In the remaining FIGS. 3 to 6 of this description however, for ease and clarity of drawing, the ends of the elongated material are shown as being permanently attached to the tops of the posts, with no excess elongated material 30 hanging down from the posts at each end.

Detailed Description of Invention—Elongated Material 30—FIGS. 1 and 2

Elongated material 30 (FIGS. 1 and 2) can be made of any suitable flexible material that can be extended out for a predetermined distance, such as string, rope, wire, plastic, fiber, or nylon. It could even be made of a rigid material such as metal, plastic, or wood. Its construction is basically governed by practicalities.

The better design is to use a flexible material that can be extended for the complete distance from the golf ball to the cup. This type of design helps the golfer learn how to envision the full length of the target line. However, if a rigid material is used to construct the elongated material, then it can still be made of a length that is long enough such that it can be pointed along the target line towards the cup. This type of design would still permit my invention to function properly as long as a portion of the rigid elongated material is positioned above the reflective surface. Note that this embodiment is not shown in the drawings because it is considered to be a minor variation of the main design of my invention.

As stated above, although a rigid elongated material of a short length is considered to be a particular embodiment of my invention, the preferred embodiment is to construct the elongated material such that it is made of a flexible material that can be extended from the golf ball along the full length of the target line to the cup. The elongated material should be constructed of a material that is strong so that it does not break when tension is applied. The elongated material should also have a small cross-sectional area and be made of a light material that is not too heavy to be held up by the respective posts. A small cross-sectional area and light material will also help to make the elongated material portable and cost-effective to manufacture. Note however, that the cross-sectional area could be any shape such as square, round, rectangular, or any other unsymmetrical shape. In the chosen embodiment, the elongated material is made of a thinly woven nylon elongated material, that has a circular cross-sectional area with a diameter of approximately 2 mm (or 2/32 ins).

The length of a flexible elongated material 30 is also governed by practicalities. If it is too long then it will sag in the middle, or it will become too heavy to be supported by posts 26 & 34. A longer flexible elongated material 30 would also be more easily affected by wind conditions, causing the invention set-up to be unstable. The optimum length for a flexible elongated material 30 is between approximately 2.1 m (or 7 ft) and 3 m (or 10 ft). In the preferred embodiment, the length of the elongated material is set at approximately 2.1 m (or 7 ft).

Operation of Invention—FIGS. 1–6

Operation of Invention—Setup—FIGS. 1 and 2

Referring to FIGS. 1 and 2, for the embodiments shown, my invention is set up by first pressing base-end post 26 into base 20 such that the base-end post is substantially upright or perpendicular to the horizontal plane of base 20. Note that as stated above, the base-end post does not have to be "exactly" perpendicular to the plane of the base in order for the invention to function properly. However, if base 20 and post 26 are constructed such that post 26 is mounted substantially vertical, then it will help to properly "line-up" the invention over cup 48.

Cup-end post 34 is then set up behind cup 48, by pushing it into the putting surface to a depth such that it will remain stable when tension is applied to elongated material 30. Refer to FIG. 2 which shows the cup-end post pushed into the putting surface. Note that the cup-end post does not have to be perfectly perpendicular to the putting surface in order for the invention to function properly. The only requirement is that when the invention is completely set up, elongated material 30 passes directly overtop of cup 48 such that it bisects cup 48 when viewing the cup from above. This is important because it will be seen later that elongated material 30 represents a "reference target line" that the golfer will use to aim the golf ball towards the cup.

Referring to the preferred embodiment shown in FIG. 1, the next step is to place plastic knob 32 onto the top of the cup-end post. Elongated material 30 is then stretched out such that when tension is applied, the elongated material will be raised above the cup and will pass directly over the centre of the cup, as described above.

Base 20 is then placed at the requisite distance from cup 48, as determined by the length of elongated material 30, and knob 28 is pressed onto the top of the base-end post. The base is then pushed further from the cup until enough tension is applied to elongated material 30 such that it is substantially straight or horizontal from the base-end post to the cup-end post. Note that the invention will still work properly even if the elongated material sags in the middle. However, for the purposes of aiming, it is better to apply enough tension to the elongated material to take most of the sag out of the length.

The golfer must then adjust the positioning of base 20 so that elongated material 30 passes directly overtop of reflective material 22 (while at the same time maintaining tension on the elongated material). As stated above, it is important that the elongated material passes overtop of the reflective material in a longitudinal direction that is exactly perpendicular to the longitudinal axis of leveller 24. The positioning of the base is made easy as a result of constructing the invention such that the base-end post is mounted behind and in the middle of the leveller (as described above). As a result of this construction the elongated material will also pass directly overtop of the leveller. The proper positioning of the base can then be accomplished by looking down on the elongated material at the point where it bisects the leveller.

The golfer can then turn the base until it can be seen that the angle between the direction of the elongated material and the longitudinal axis of the leveller is approximately 90 degrees.

Once base 20 is positioned properly, the next step is to ensure that the base is either on a level putting surface or that it is positioned on a sloped putting surface such that the type of slope does not affect the functioning of the invention. The golfer does this by viewing air bubble 44 contained within leveller 24. If the bubble is in the middle of the leveller then the base is positioned properly and the invention will function. Note that black lines 46 around the leveller are used for reference to easily indicate the position of the air bubble.

If air bubble 44 is not in the middle of the leveller and instead has settled to one side or the other of the leveller, then the invention will not function properly. Consequently, the base would have to be relocated to a different place on the putting surface where the proper levelling requirement is accomplished. Note that if the base is moved to a new location, then the cup-end post will also have to be repositioned so that elongated material 30 passes directly overtop of the centre of the cup.

If air bubble 44 is seen to be in the middle of leveller 24 in the above setup, then the base is positioned properly. The only remaining step at this point, is to reverify that elongated material 30 passes directly overtop of the centre of the cup. This can be accomplished by looking down at the elongated material as it passes overtop of the cup. If it is seen that the elongated material does not pass over the centre of the cup, then either the cup-end post or the base itself must be repositioned so that the path of the elongated material does in fact bisect the cup. Note however, that if either the cup-end post or the base are re-positioned, then the base will have to be re-aligned. As described above, this is easily accomplished by simply turning the base until the longitudinal direction of the elongated material is perpendicular to the longitudinal axis of the leveller.

Once the invention has been set up as described above, it is ready for use. As shown in FIG. 1, the golf ball is then placed on the putting surface, directly beneath elongated material 30 and at some point between base 20 and cup 48. The golf ball can be placed at different points between the base and the cup and the invention will still work properly. The only limiting factor is that if the golfer gets too far away from the base, then he or she will not be able to see the elongated material's reflection in reflective material 22. In order for the invention to work properly, reflection 60 must be visible.

Note that the whole invention could have been set up with the golf ball already in place. However, it is easiest for the golfer to first determine the type of putt that he or she wants to practice, set up the invention properly, and then place the golf ball afterwards.

The golfer then uses a putter club 62 to stroke the golf ball. Putter 62 has a putter head 64 which is at the bottom of the putter. Putter head 64 in turn, has a putter face 66, which is the flat part of the putter head that actually makes contact with the golf ball.

Figure 3:
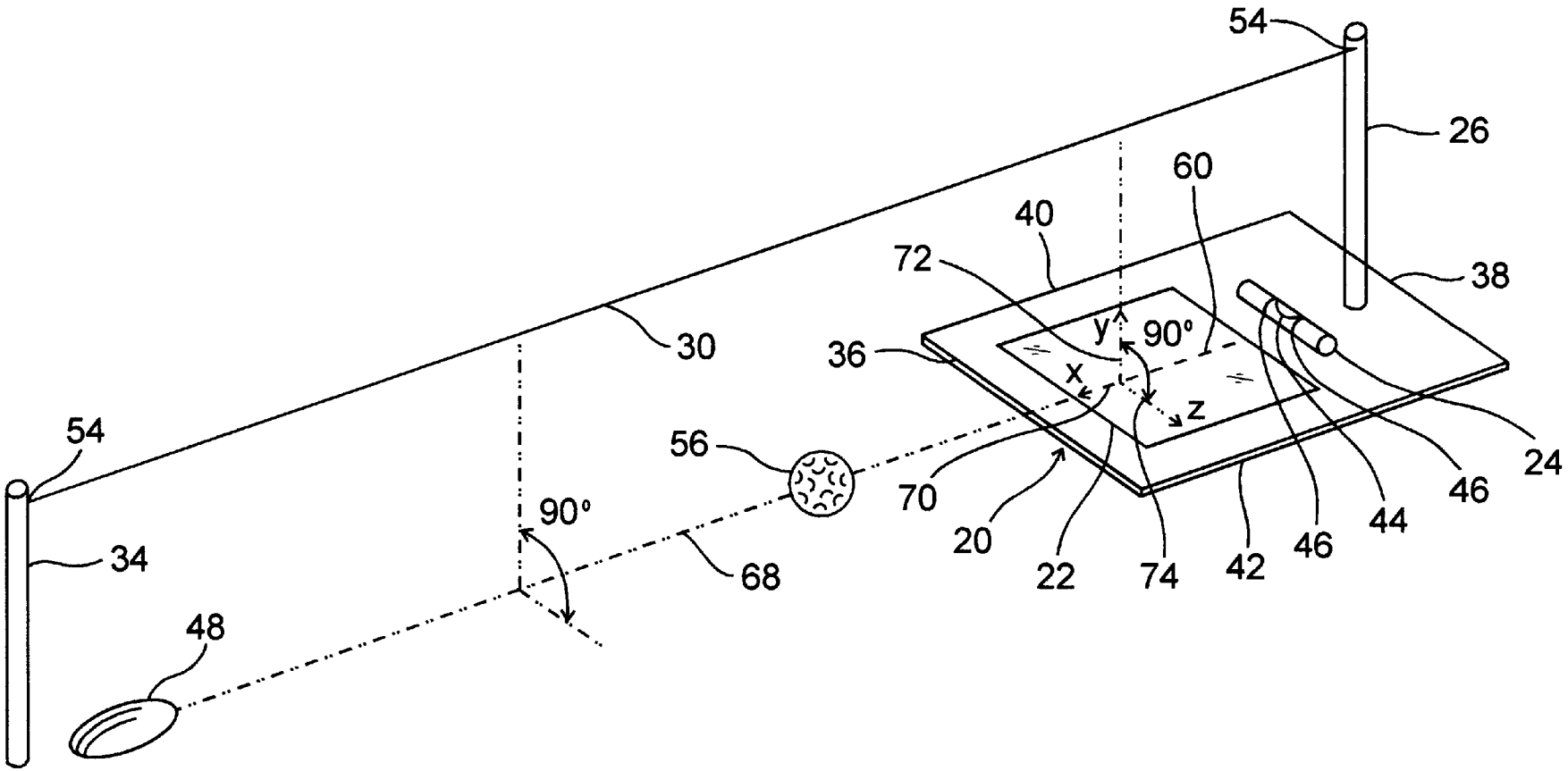
FIG. 3 shows the same perspective view as the prior FIG. 2, but with imaginary axes shown in order to describe the theory of operation.

Operation of Invention—Theory—FIGS. 1 & 3

Introduction to Theory of Operation—FIG. 3

In order for the golfer to be consistently successful in making a putting stroke, a number of skills must be learned. The golfer must first learn how to assume a proper stance that is square to the desired line of travel of the golf ball. The golfer must then learn how to position his or her eyes exactly overtop of the "target line", which is the desired path of the golf ball from the golf ball's resting position, to the cup. (In the remaining portion of this description, the desired target line is referred to as the "proper target line".)

In addition to positioning his or her eyes exactly overtop of the proper target line, the golfer must at the same time position his or her eyes overtop of the golf ball. The golfer must then learn to swing the putter so that the direction that the putter head travels along the putting surface, is always along the proper target line prior to and after making contact with the golf ball. Lastly, the golfer must learn to position the face of the putter so that it always makes contact with the golf ball at an angle that is square to the direction of the proper target line.

If any of the above components of proper putting are absent or flawed, then the golfer will not be able to achieve accurate and consistent putting strokes. Therefore, this invention assists the golfer in learning the above required skills. In particular, this invention provides a "reference target line" which is represented by elongated material 30, as shown in FIG. 3. This reference target line is set up so that it is exactly overtop of the proper target line and the golf ball. The golfer is then able to use the reference target line to learn how to accomplish the above putting skills.

This section describes the theory behind using the invention to learn the proper putting skills. First of all, the operation of the invention is described, to show how the golfer is able to use the invention to position his or her eyes exactly overtop of the proper target line. Following this, an explanation is provided regarding the placement of the golfer's head in general. This section then provides an explanation of the theory of operation of the invention on a horizontal putting surface, and then on non-horizontal putting surfaces. The reader is provided with details of when the invention will function properly and when it will not function properly.

Positioning the Eyes Overtop of the Proper Target Line—FIG. 1

To properly position the golfer's eyes, he or she first steps up to the reference target line, as presented by elongated material 30; (see FIG. 1). The golfer stands such that the front of his or her body is facing a direction that is transverse to the longitudinal direction of the reference target line. The head is kept forward (relative to the golfer), as opposed to being turned towards the base or towards the cup. Note though, that the head can be tilted downwards to whatever angle is comfortable, as long as the head does not turn to the left or to the right. The golfer then turns just his or her eyes so as to look at both elongated material 30 overtop of base 20 and at reflection 60 of the elongated material within reflective material 22. If the golfer can see both the elongated material and the elongated material's reflection, then the golfer does not have his or her eyes exactly overtop of the reference target line.

If the golfer sees reflection 60, it means that the image of elongated material 30 has been reflected by the reflective material back to the golfer's eyes, at angle that is not perpendicular to the surface of the reflective material. If the angle of reflection is not perpendicular to the reflective material, then it means that the golfer's eyes are not exactly overtop of the elongated material.

Therefore, if the golfer sees reflection 60 of the elongated material, then he or she must slowly move his or her head either forward or backward (relative to the golfer and depending upon which side of the elongated material the reflection is on), until the elongated material and the elongated material's reflection are seen to come together. When the reflection of the elongated material disappears from view beneath the elongated material itself, it will mean that the golfer's eyes are exactly overtop of the reference target line. Consequently, the golfer's eyes will at the same time be exactly overtop of the proper target line.

Theory Regarding Placement of the Head—FIG. 1

When positioning the golfer's head and eyes (see FIG. 1), it is important (as stated above), that the golfer's head is facing forward and not turned to the right. If the head is turned towards the base when viewing the elongated material and the elongated material's reflection, then it will be difficult for the golfer to properly adjust his or her head to line up the elongated material's reflection exactly beneath the elongated material. This is because the golfer will see two reflections of the elongated material when he or she focuses on the elongated material. Or, the golfer will see two elongated materials if he or she focuses on the elongated material's reflection. This type of optical situation results because of the fact that a person has two eyes and the two eyes can only focus on one point at a time. An object that is further away from the focal point will be blurry, and it will appear that there are two of the further-away objects. This is because an image of the further-away object will be received by each eye and the brain will interpret this as two objects.

These two further-away objects will be displaced along an axis that is exactly parallel to an axis that follows the path of a line that is drawn from one eye to the other. In other words, if a person is standing on a horizontal surface and the person's head is facing straight forward, then the blurry further-away objects would be seen to be displaced horizontally. If the person turned his or her head completely sideways such that the eyes are vertical to the surface that he or she is standing on, then the blurry objects would appear to be displaced vertically.

The above theory can now be applied to the elongated material of the invention. If the golfer turns his or her head towards base 20 and focuses on reflection 60 of the elongated material, then he or she will see two elongated materials that are displaced from side to side along an axis that is transverse to the longitudinal axis of the elongated material. However, if the golfer keeps the head facing forward, turns only his or her eyes towards the base, and then focuses on the elongated material's reflection, then he or she will see only one elongated material 30. This then explains why the golfer's head must not look directly at the elongated material and the elongated material's reflection.

It can now be explained as to why the optical problem is alleviated by keeping the head facing forward and only turning the eyes towards the base. If the golfer keeps the head facing forward, turns his or her eyes towards the base, and then focuses on the elongated material's reflection, then he or she will only "think" that he or she sees only one elongated material 30. In actuality, the golfer will see two elongated materials, but the elongated materials will be displaced lengthwise along the same longitudinal axis as the elongated material, thereby making the brain think that it is only seeing one elongated material 30.

The above optical problem could also be alleviated by simply closing one eye when looking directly at the base. In this way, if the golfer closed one eye and focused the other on the elongated material for example, he or she would see only one reflection of the elongated material in the reflective material. The further problem that this creates however, is that the golfer would have to turn his or her head back towards the opposite direction to look at the cup. This would very likely cause the golfer to inadvertently move his or her eye off of the proper target line when the head is turned.

Therefore, when the golfer steps up to the proper target line, he or she must keep the head forward and turned downwards to a comfortable angle, whereby the golfer can easily see the base when just the eyes are turned in that direction, and such that the golfer can also easily see the cup when just the eyes are turned in the opposite direction.

Theory of Operation on a Horizontal Putting Surface—FIG. 3

When the golfer has properly positioned his or her eyes exactly overtop of the reference target line (i.e. elongated material 30), as explained above, then the eyes will at the same time be exactly overtop of the proper target line that runs from the golf ball to the cup. Essentially, by positioning the eyes properly, the golfer will be looking along the top edge of a vertical plane that travels from the base to the cup. This vertical plane can be pictured as depicted in FIG. 3. As shown, the top edge of the vertical plane is outlined by elongated material 30 and the bottom edge of the vertical plane is outlined by a proper target line 68 which travels from reflective material 22 to cup 48. The plane is vertical in the sense that it is exactly perpendicular to the horizontal plane represented by the reflective material, (i.e. with reference to a horizontal putting surface).

As shown in FIG. 3, one axis 70 of the vertical plane can be represented by the letter "x". This axis is horizontal in FIG. 3 and runs along the proper target line. A second axis 72 of the vertical plane can be represented by the letter "y". This axis is vertical in that it is perpendicular to the plane of the reflective material. A third axis 74 depicted in FIG. 3, can be represented by the letter "z". This axis is shown to run perpendicular to the vertical plane and it is therefore perpendicular to both the "x" and the "y" axes. As may be seen, the "x" and "z" axes make up the plane of the reflective material and both will be horizontal when the base is set up on a horizontal putting surface. Note that axes "x" 70, "y" 72, and "z" 74, are all perpendicular to each other.

Introduction to Theory of Operation on Non-Horizontal Putting Surface—FIG. 3

All of the descriptions of operation of the invention thus far, have been with reference to a horizontal putting surface. Referring to FIG. 3, the theory behind the types of sloped (i.e. non-horizontal) surfaces that the invention may be used upon, can now be explained. Briefly, the invention will function properly when the base is set up on a putting surface where front side 36 of the base faces downhill or uphill, but the invention will not function properly if the front side of the base faces along the side of a hill.

Theory Re: Small Object above Mirror & Horizontal Putting Surface—FIG. 3

This section describes the theory behind the reflection of a small object that is above the reflective material, when the reflective material is situated on a horizontal putting surface. Once this basic theory is understood, it can then be applied to the situation where the reflective material is on a non-horizontal plane. Finally, the theory can then be applied to the situation where elongated material 30 is above the reflective material (i.e. instead of just a single small object) and where the reflective material is on a non-horizontal plane.

Therefore, the first step is to examine the reflection of a small object (i.e. instead of the elongated material of the invention) above the reflective surface, when the reflective surface is situated on a horizontal plane. Referring to FIG. 3, one could imagine a small object above the reflective material, such as the point where "y" axis 72 meets with the elongated material. If this point could be viewed exactly from above so that the reflection of the point was covered by the point itself, then one would actually be looking exactly down the "y" axis. This coincides with the above explanation, where it has been stated that for the reflection of an object to be hidden from view by the object itself, when looking directly down upon the object, the image of the reflected object must return to the object and the person's eyes, at an angle that is exactly perpendicular to the plane of the reflective material. In this case, the "y" axis is perpendicular to the axes of the reflective material, represented by "x" 70 and "z" 74.

Theory Re: Small Object above Mirror & Downhill Putting Surface—FIG. 3

The next step is to examine how the reflection of the same small object or point is affected when the base is positioned such that it is no longer on a horizontal plane. First, the "downhill" scenario will be examined whereby front side 36 of the base is positioned so that it is facing down the hill or slope. Referring to FIG. 3, if the front side of the base is facing downhill, then the plane of reflective material 22 will have rotated about the "z" axis. Therefore, the "z" axis will still be horizontal, but the "x" axis will have rotated about the "z" axis such that the "x" axis is no longer horizontal. The "x" axis will be angled downwards from the horizontal and will point down the hill or slope.

As may be seen in FIG. 3, the "y" axis will also have rotated about the "z" axis such that the "y" axis will no longer be vertical. The "y" axis will be angled in a direction down the hill such that if the "y" axis could be viewed from the right or left side of the base, it would be seen to be leaning downhill. The next step is to consider the same small object that was previously viewed from above the reflective material and imagine that this point is still in exactly the same position in space that it was in the above case. Note therefore, that the object (or point) will no longer be at the top of the "y" axis where it meets with the elongated material in FIG. 3, because the "y" axis has angled forward along the proper target line.

If the imaginary point could be viewed exactly from above, with the eyes in the same position as they were with the horizontal case, then the reflection of the point would no longer be covered by the point. In fact, one would see the point's reflection in the reflective material and this reflection would be seen to have moved along the "x" axis (i.e. the proper target line), towards back side 38 of the base. This shows therefore, that when the plane of the reflective material is rotated about the "z" axis such that the front side of the base faces downhill, then the reflection of an object in the reflective material is displaced towards the back side of the base in a direction that is along or parallel to the proper target line.

In order to again view the imaginary point from above the point, and from a position whereby the reflection of the point is hidden by the point itself, one would have to move his or her eyes in the same direction that the "y" axis has angled towards. In other words, one would have to move his or her eyes in the direction parallel to the proper target line towards the cup, (i.e. assuming that the imaginary point of reference was kept exactly at the same position in space). If the eyes now look at the point from above, at the same distance from the eyes to the point as the point is from the reflective material, then the eyes would have to be moved the same distance along a path that is parallel to the proper target line, as what the reflection of the point has moved towards the back side of the base. Once the reflection of the point is again seen to be hidden by the point itself, then one would once again be looking down at the plane of the base, along a path that is exactly parallel to the "y" axis.

Note that one's eyes would therefore no longer be exactly vertically above the point, in reference to a horizontal plane below the point; (i.e. the eyes will have moved downhill). The important factor however, is that even though the eyes had to be moved (i.e. to keep the reflection hidden by the point), the eyes have moved in a direction parallel to the proper target line. Therefore, referring to FIG. 3, when reflective material 22 is rotated about the "z" axis, the reflection of a stationary object above the reflective material, will be displaced within the reflective material towards the back side of the base. If the object was above the proper target line, and if one's eyes are repositioned such that the reflection of the object is again covered by the object itself when looking down upon the object, then the eyes would have to be moved in a direction that is towards the cup and parallel to the proper target line. As a result, one's eyes would continue to be exactly overtop of the proper target line when being repositioned.

Theory Re: Elongated Material above Mirror & Downhill Putting Surface—FIG. 3

If the above theory is now applied to elongated material 30, it can be seen that the elongated material is actually made up of numerous small points that are all arranged in a longitudinal direction along the reference target line towards the cup. Therefore, referring to FIG. 3, if the plane of the reflective material is rotated about the "z" axis, the reflection of each of the individual points that compose the elongated material (i.e. those points that are above the reflective material), would be shifted or displaced within the reflective material in a direction that is exactly along the "x" axis and along the proper target line. The difference with this situation as compared to the single-point situation described above, is that when the golfer has his or her eyes properly positioned above the elongated material, (i.e. such that the reflection of the elongated material is hidden by the elongated material itself), the golfer would not be able to see any shift or displacement of the elongated material's reflection when the reflective material is rotated about the "z" axis. This is because any displacement of the reflection of a particular point of the elongated material, along the proper target line, would be hidden from view by other points of the elongated material.

Therefore, displacing the reflection of the elongated material within the reflective material, in a direction that is parallel to the longitudinal direction of the elongated material itself, does not affect the functioning of the invention. The longitudinal displacement of the reflection of the elongated material is not visible to the golfer when the golfer positions his or her eyes overtop of the elongated material. Consequently, a vertical plane is maintained in the sense that when the golfer's head is positioned such that he or she sees only the top of the elongated material, with the elongated material's reflection hidden by the elongated material, then the golfer's eyes will be exactly above the proper target line.

Conclusion of Theory Re: Uphill & Downhill Putting Surfaces—FIG. 3

The above theory explains why the invention continues to function properly when it is set up such that front side 36 of the base faces downhill. The same theory can be applied to the situation where the invention is set up such that the front side of the base faces uphill. The only difference is that the reflection of an object above the reflective material, would be displaced in a direction towards the front of the base, (i.e. as opposed to being displaced towards the back side of the base in the downhill scenario). Therefore, if the small object is above the reflective material and exactly overtop of the "x" axis (i.e. the proper target line), then the reflection of the object would be displaced towards the front side of the base along the proper target line, as the base is rotated about the "z" axis; (i.e. as the base is rotated such that the front side of the base faces uphill (see FIG. 3)).

If instead of a small object, one views the elongated material above the reflective material, any displacement of the elongated material's reflection as the front side of the base is rotated to face uphill, would not be visible. As in the downhill scenario, the displacement of the elongated material's reflection in the reflective material would be along the proper target line and therefore would be hidden from view by the elongated material itself.

In conclusion, whenever the base is set up on a non-horizontal surface, such that the front side of the base faces either uphill or downhill, then the reflection of the elongated material in the reflective material will be displaced. However, in the uphill and downhill situations, the reflection of the elongated material will be displaced in a direction that is along the proper target line. Consequently, when the golfer has positioned his or her eyes overtop of the elongated material such that the reflection of the elongated material in the reflective material is hidden by the elongated material itself, then the golfer will not be able to see any displacement of the elongated material's reflection. The golfer's eyes will continue to be correctly positioned exactly overtop of the proper target line. As a result, the invention will continue to function properly in the uphill and downhill situations.

Theory Re: Small Object above Mirror & Side of Hill Putting Surface—FIG. 3

This section describes the theory behind the reflection of a small object that is above the reflective material, when the invention is set up such that it runs along the side of a hill or slope. Referring to FIG. 3, with this scenario it can be seen that front side 36 of the base will face in a direction that is along the side of the hill, and either right side 40 or left side 42 of the base, will face downhill. For example, if the left side of the base faces downhill, then the right side will face uphill.

First, the reflection of a small object (or point) will be examined when the base is positioned such that the front side of it faces along the side of a hill and where the left side of the base faces downhill. Referring to FIG. 3, if the left side of the base faces downhill, then the plane of the reflective material will have rotated about "x" axis 70. Therefore, the "x" axis will still be horizontal, but "z" axis 74 will no longer be horizontal. The "z" axis will be angled downwards from the horizontal and will point down the hill or slope.

As may be seen in FIG. 3, "y" axis 72 will also have rotated about the "x" axis such that the "y" axis will no longer be vertical. The "y" axis will be angled in a direction down the hill such that if the "y" axis could be viewed from the front side of the base, it would be seen to be leaning downhill. Now, consider the same imaginary point that was previously considered in the horizontal-putting-surface scenario. Recall that the point considered, was situated where the "y" axis intercepted with the elongated material above the reflective material when the reflective material was placed on a horizontal plane. Imagine that this point is still in exactly the same position in space, as it was in the horizontal-putting-surface scenario. Note therefore, that the point will no longer be at the top of the "y" axis when the plane of the reflective material is rotated about the "x" axis, because the top of the "y" axis will have angled downhill, away from the proper target line.

If the point is now viewed exactly from above, with the eyes in the same position as they were with the horizontal-putting-surface scenario, then the reflection of the point would no longer be covered by the point itself. In fact, one would now see the point's reflection in the reflective material and this reflection would be seen to have moved along the "z" axis towards the right side of the base; (i.e. the reflection will have moved uphill in a direction that is transverse to the proper target line). This shows therefore, that when the plane of the reflective material is rotated about the "x" axis such that the left side of the base faces downhill, the reflection of an object in the reflective material will be displaced towards the right side of the base in a direction that is transverse to the proper target line.

In order to again view the previous imaginary point from above such that the reflection of the point is hidden by the point itself, one would have to move his or her eyes in the same direction that the top of the "y" axis angled towards. In other words, one would have to move his or her eyes in a direction that is transverse to the proper target line, (i.e. assuming that the imaginary point of reference is kept exactly at the same position in space). Therefore, if the eyes now look at the point from above, at the same distance from the eyes to the point as the point is from the reflective material, then the eyes will have to be moved to the left side of the base the same distance along a path that is parallel to the "z" axis, as what the reflection of the point has moved towards the right side of the base. Once the reflection of the point is again seen to be hidden by the point itself, then one would once again be looking down at the plane of the reflective material, along a path that is exactly parallel to the "y" axis.

Note that at this time, one's eyes would therefore no longer be exactly vertically above the point, in reference to a horizontal plane below the point; (i.e. the eyes will have moved downhill). Consequently, in moving the eyes to keep the reflection of the point hidden by the point itself, one has had to move his or her eyes away from the proper target line. Therefore, referring to FIG. 3, when the reflective material is rotated about the "x" axis, the reflection of an object above the reflective material, will be displaced within the reflective material in a direction that is transverse to the proper target line. As a result, one's eyes would not be maintained exactly overtop of the proper target line if an object is viewed from above at a position whereby the object's reflection is hidden by the object itself.

Theory Re: Elongated Material above Mirror & Side of Hill Surface—FIG. 3

If the above theory is now applied to elongated material 30, it can be seen that the elongated material is actually made up of numerous small points that are all arranged in a longitudinal direction along the reference target line towards the cup. Therefore, referring to FIG. 3, if the plane of the reflective material is rotated about the "x" axis, each of the individual points that compose the elongated material (i.e. those points that are above the reflective material), would be shifted or displaced within the reflective material in a direction that is transverse to the "x" axis and parallel to the "z" axis. Therefore, in this scenario, if the golfer looks down upon the elongated material overtop of the reflective material, and the reflective material is rotated about the "x" axis, then the golfer would see the reflection of the elongated material being displaced within the reflective material. If the golfer moves his or her eyes to compensate for the displacement, (i.e. so that the reflection of the elongated material is again hidden by the elongated material itself), then the eyes will have moved away from being exactly overtop of the proper target line.

In the scenario where the left side of the base faces downhill, the elongated material's reflection will be displaced in a direction towards the right side of the base. The golfer's eyes therefore, would have to be moved in a direction towards the left side of the base to again cover the reflection by the elongated material itself. In the scenario where the right side of the base faces downhill, the elongated material's reflection will be displaced in a direction towards the left side of the base. The golfer's eyes therefore, would have to be moved in a direction towards the right side of the base to again cover the reflection by the elongated material itself. In both scenarios, the golfer's eyes would have to be moved away from the proper target line whenever the reflective material is rotated about the "x" axis; (i.e. whenever the invention is set up along the side of a hill or slope).

Therefore, displacing the reflection of the elongated material within the reflective material, in a direction that is transverse to the longitudinal direction of the elongated material itself, will affect the functioning of the invention. The displacement of the reflection of the elongated material will be visible to the golfer when the golfer positions his or her eyes overtop of the elongated material. Consequently, the golfer will have to move his or her eyes away from the proper target line when positioning his or her eyes such that the reflection of the elongated material is hidden by the elongated material itself.

Conclusion of Theory Re: Side of Hill Putting Surfaces—FIG. 3

In conclusion, if the reflective material is rotated such that the left side of the base faces downhill and the right side of the base faces uphill (or visa versa), then the reflection of the elongated material within the reflective material, will be displaced in a direction that is transverse to the longitudinal direction of the elongated material and transverse to the proper target line. Consequently, if the golfer positions his or her eyes above the elongated material such that the reflection of the elongated material is hidden by the elongated material itself, then the golfer's eyes will not be positioned exactly overtop of the proper target line.

Therefore, the invention does not function properly when it is set up along the side of a hill, or when the base is on a non-horizontal surface such that either the right side or the left side of the base is raised. In order to easily determine whether the invention can be used on a particular putting surface however, the base has been designed with the leveller previously described. Once the invention is set up, the golfer need only check the leveller to verify that the air bubble is in the middle of the cylinder. If the air bubble is in the middle, then the invention will function properly. If the air bubble has moved to either end of the cylinder, then the invention will have to be set up at a different location.

Figure 4:
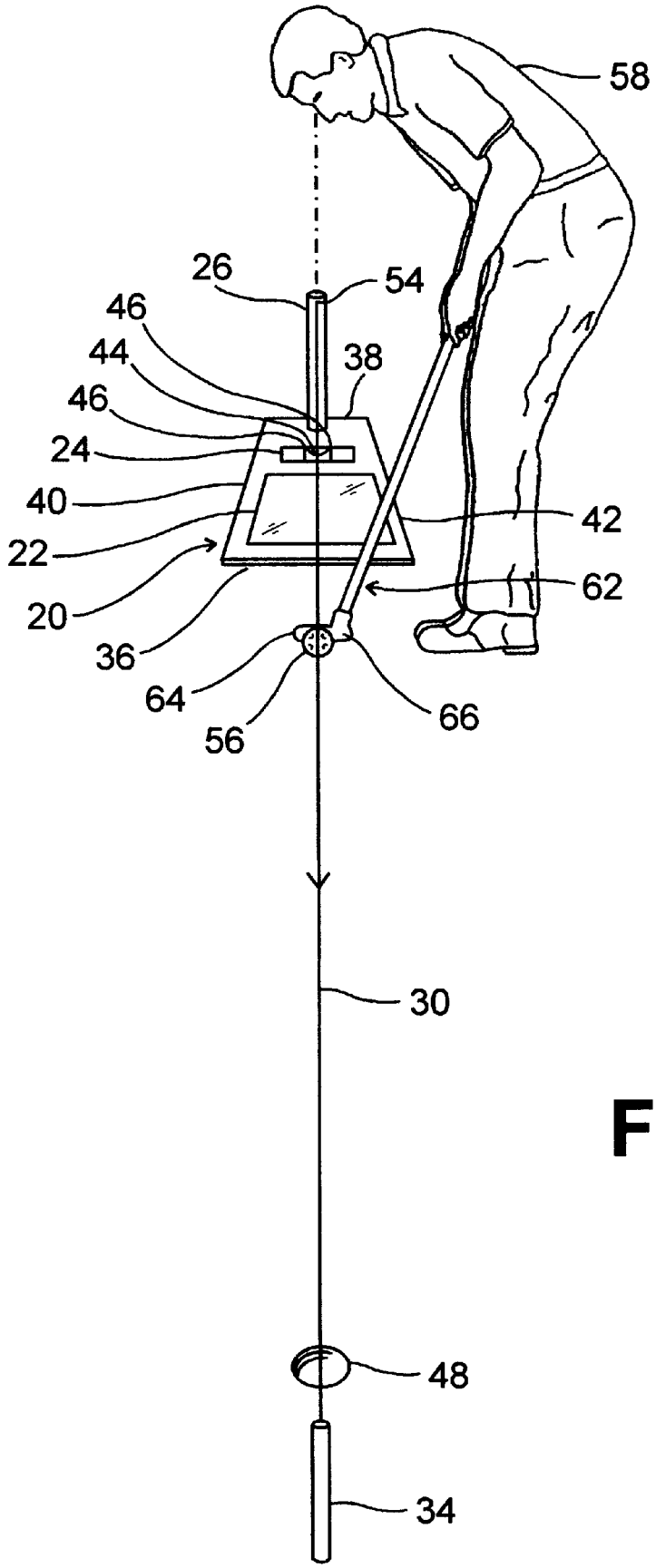
FIG. 4 shows a perspective view from behind the cup, with the golfer having properly addressed the golf ball and the target line.

Operation of Invention—Learning Proper Putting Swing—FIG. 4

The invention can now be used to first learn how to make a proper putting swing. Assuming that the invention is set up properly according to the above instructions (and either on a flat, uphill, or downhill putting surface), the initial step is for the golfer to learn how to properly address the ball, or in this case, the proper target line. The golfer will then learn to use the elongated material as a reference target line to establish the proper target line on the putting surface. Refer to FIG. 4, which is a perspective view looking towards the front side of the base, from behind the cup.

The golfer must first approach the elongated material at a distance from the base whereby the golfer is able to see the elongated material's reflection in the reflective material. The golfer assumes a narrow stance, facing a direction such that his or her body is square to the elongated material (i.e. square to the reference target line), as shown in FIG. 4. The golfer then bends his or her knees only slightly, at the same time as bending at the hips. The elbows are bent such that the forearms are in line with the shaft of the golf club. The golfer holds the putter such that his or her palms are facing each other and the thumbs are on top of the grip.

The golfer then places his or her eyes exactly overtop of the elongated material. In doing this, the golfer will actually have placed his or her eyes exactly overtop of the proper target line that is beneath the elongated material and that runs exactly to the center of the cup. The golfer positions his or her eyes according to the instructions previously described. Therefore, while keeping the head facing forward (but tilted downwards to a comfortable degree in order to see the ground), the golfer turns just his or her eyes to look at base 20. The golfer then looks for reflection 60 of the elongated material within reflective material 22. While viewing the elongated material and the elongated material's reflection at the same time, the golfer either leans forward or backwards, until the elongated material and the elongated material's reflection are seen to come together. When the elongated material's reflection is hidden by the elongated material itself, it will mean that the golfer's eyes are exactly overtop of the elongated material and the proper target line.

The putting stroke is the shortest swing and it requires little body movement, as only the arms are used to swing from the shoulders. In order to putt consistently, the golfer must learn to swing the putter such that putter head 64 travels exactly along the proper target line. Although for a long putt, the swinging arc of the putter head may follow a path that is slightly inside of the proper target line on the backswing, it is still important that the putter head follows the proper target line prior to and at the point of impact with the golf ball. On short putts, the swing of the putter head should travel only along the proper target line. If the putter head does not travel along the proper target line, then the golf ball will also not travel along the proper target line after it has been struck by the putter head.

The golfer can use the invention to ensure that the swing of the putter head travels along the proper target line, by keeping the putter head beneath elongated material 30 as it travels through the back swing, stroke, and follow through. The golfer is able to do this by watching the elongated material and the putter head at the same time as the putter swing is made. When the golfer looks down at the elongated material and the putter head, he or she simply maintains the positioning of the putter head such that the elongated material passes overtop of the putter head at a constant point. In other words, the elongated material should be seen to bisect the putter head at the same point throughout the swing.

The next important factor involved in the putting swing, is for the golfer to ensure that face 66 of the putter is always kept exactly square to the longitudinal direction of the proper target line and square to the direction of travel. If the face of the putter is not kept square, then upon striking the golf ball it will cause the golf ball to go in an undesired direction, even if the swing of the putter head itself was along the proper target line.

The golfer can ensure that the face of the putter is always kept exactly square to the longitudinal direction of the proper target line and square to the direction of travel, by using the invention. Since the golfer's eyes will be overtop of the proper target line, he or she will be able to see the angle of the putter face when it makes contact with the golf ball. The golfer, while looking downward and viewing the elongated material and the face of the putter at the same time, can simply adjust the putter head so that the longitudinal direction of the elongated material is exactly perpendicular to the face of the putter. The elongated material should be seen to bisect the face of the putter at the point where the golfer wants the putter face to contact the golf ball.

Once the above putting-swing techniques are understood, the golfer can use the invention to practice his or her putting swing. Using just the arms while swinging from the shoulders, the golfer swings the putter into the backswing. The putter is then brought through the putting stroke and the follow-through. At all times the golfer must make sure that the head of the putter travels along the proper target line and that the face of the putter is kept square to the direction of travel. This is accomplished by the golfer continuing to view the elongated material and the head of the putter at the same time. Using the elongated material as the reference target line, the golfer can keep the putter head traveling along the proper target line by positioning it such that it stays beneath the elongated material. At the same time the golfer can keep the face of the putter positioned such that the longitudinal direction of the elongated material continues to be perpendicular to the face of the putter.

Using the invention and the above instructions, the golfer should practice his or her putting swing until it feels comfortable and natural. It is important to note that the above proper swinging techniques are critical components of accurate and consistent putting. Note however, that these techniques could not be practiced if the golfer is not able to positively determine whether his or her eyes are exactly overtop of the proper target line. This invention therefore, first helps the golfer to learn how to position his or her eyes properly. The invention then further helps the golfer to accomplish a proper putting swing.

The next stage in training is for the golfer to learn to address the proper target line and position his or her eyes exactly overtop of the proper target line without first using the elongated material and the elongated material's reflection. The golfer can practice walking up to the reference target line represented by the elongated material and assuming the proper body stance, and then attempting to position his or her eyes overtop of the elongated material. He or she can then turn the eyes towards the base to see whether the elongated material is exactly overtop of its reflection within the reflective material. This will help the golfer to learn whether he or she normally tends to lean too far forward or too far backwards, when placing the eyes overtop of the proper target line.

Operation of Invention—Learning To Stroke the Ball Properly—FIG. 4

Once the golfer has learned how to address the proper target line, how to place the eyes exactly overtop of the proper target line, how to produce a consistent and proper backswing, stroke, and follow-through, he or she is then ready to practice stroking the ball.

Referring to FIG. 4, the golfer first sets up the invention according to the above set-up instructions. Next, the golfer places golf ball 56 beneath elongated material 30, at a distance from the cup according to the length of putt that the golfer wants to practice. Note though, that the golf ball must be placed close enough to base 20 such that the golfer is able to see both the elongated material and the elongated material's reflection within reflective material 22.

The golfer then uses the invention to once again properly address the proper target line. Note that in this case though, the golfer must also pay attention to properly addressing the golf ball. When addressing the proper target line and assuming the proper stance as described above, the golfer should ensure that the golf ball is just inside of the left foot (for a right-handed golfer), as opposed to being in between the feet and at the same distance from each foot.

The golfer then uses the invention to position his or her eyes exactly overtop of the elongated material, as described above. At this point, the golfer can also look down to verify that his or her eyes are also overtop of the golf ball. If the elongated material is seen to be exactly overtop of the golf ball, such that the elongated material bisects the golf ball, then the golfer's eyes will be exactly overtop of the golf ball and the golf ball will be on the proper target line.

If the elongated material is not seen to bisect the golf ball, then the eyes will not be overtop of the golf ball and the golf ball will not be on the proper target line. In order to use the invention, the golf ball must be placed beneath the elongated material and on the proper target line. Therefore, the golf ball must be moved either forwards or backwards (relative to the golfer), until the golf ball is seen to be exactly beneath the elongated material when the eyes are properly positioned above the elongated material.

Note that when the golf ball is properly placed beneath the elongated material and on the proper target line, it may be seen to be slightly to the left or slightly to the right of the golfer's eyes. In this case, the golfer can very slightly move his or her head along the proper target line until the eyes are overtop of the golf ball. In doing this however, the golfer must ensure that the head is still facing forward and the body is still square to the elongated material, as described above. If the golf ball is too far to the left or right, then the golfer will have to either reposition the golf ball or readdress the proper target line and the golf ball.

Once the golfer has positioned his or her eyes overtop of the proper target line and the golf ball, the next step is to stroke the ball. The golfer can now apply the back swing, stroke, and follow-through techniques that were learned and practiced above. If the swing of the putter head is kept along the proper target line, and if the face of the putter is kept square to the longitudinal direction of the proper target line, then when the putter face strikes the golf ball, the golf ball will travel along the proper target line towards the cup.

As in the above putting-swing practice, the golfer can use the invention to learn how to properly address the golf ball and position his or her eyes exactly overtop of the golf ball. Once this has become comfortable and natural to the golfer, he or she can practice addressing the golf ball and positioning the eyes without first using the elongated material and its reflection. The golfer can then use the invention to "check" whether he or she has learned the proper positioning.

Once the golfer has learned to properly address the golf ball and position his or her eyes exactly overtop of the golf ball and the proper target line, he or she can then learn to stroke the ball consistently and accurately. As the golfer's putting skills improve, the golf ball can be moved to different distances from the cup. The golfer can then learn to successfully putt the ball with different degrees of force.

Figure 5:
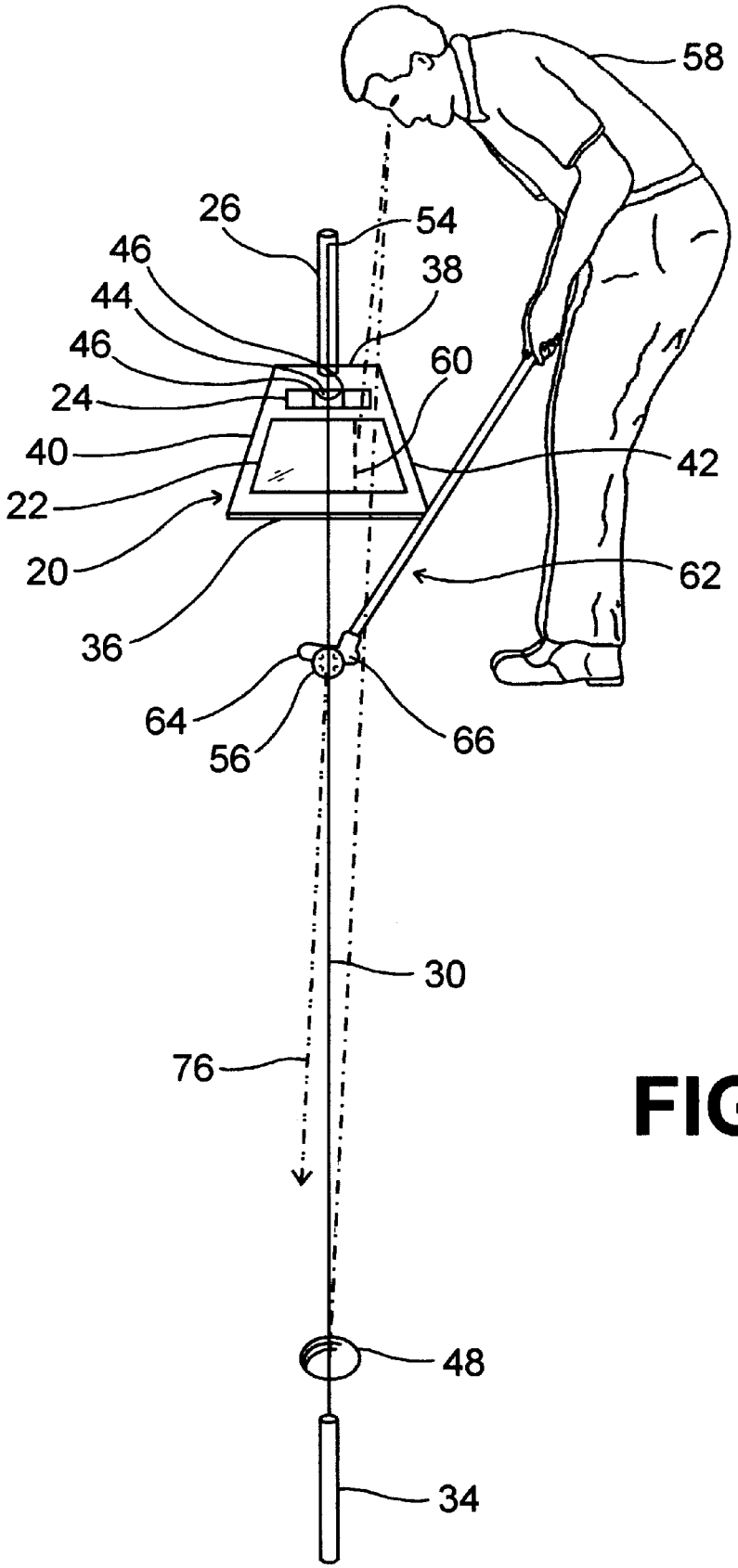
FIG. 5 shows a similar perspective view as the prior FIG. 4, but with the golfer having improperly addressed the golf ball and the target line.
Figure 6:
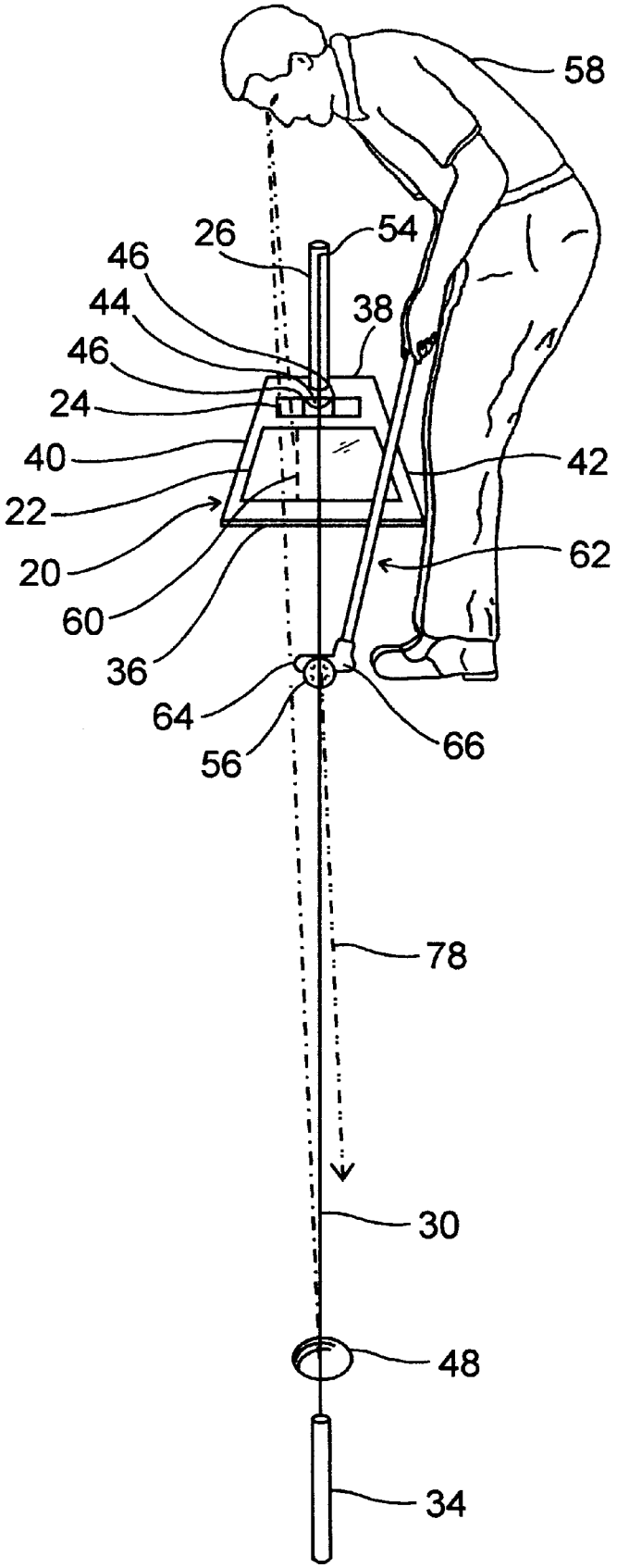
FIG. 6 shows a similar perspective view as the prior FIG. 4, but with the golfer having improperly addressed the golf ball.

Operation of Invention—Eyes Overtop of Ball & Target Line—FIGS. 4–6

Two of the most important qualities of this invention are that it helps the golfer to learn how to properly address the proper target line and the golf ball, and it helps the golfer to learn how to position his or her eyes exactly overtop of the proper target line and the golf ball. These are two very important aspects of consistent and accurate putting.

If the golfer does not properly address the proper target line and place his or her eyes exactly overtop of the proper target line, then the golfer will tend to swing the putter head along a path that is not in line with the proper target line. Consequently, when the face of the putter strikes the golf ball, it will cause the golf ball to travel along a path that is different from the desired path to the cup.

If the eyes are not positioned exactly overtop of the golf ball, then the golfer will envision a target line that is different from the proper target line that the golf ball must follow to reach the cup. Furthermore, if the eyes are not overtop of the golf ball, then the golfer will not be able to ensure that the face of the putter strikes the ball exactly square to the intended direction of travel of the golf ball.

FIG. 4 demonstrates a proper putting stroke. The golfer has addressed the proper target line and the golf ball according to the instructions stated above. The golfer's eyes are positioned exactly overtop of the proper target line and the golf ball. The golfer is able to verify this by turning his eyes towards the base and viewing elongated material 30 and reflection 60 of the elongated material in the reflective material. In this case, the golfer does not see the elongated material's reflection because it is beneath the elongated material and therefore hidden by the elongated material.

The golfer then turns his eyes towards the cup to see the desired direction of travel of the golf ball. Since the golfer's eyes are exactly overtop of the elongated material, the desired direction of travel of the golf ball (i.e. the proper target line), is in fact the same as the longitudinal direction of the elongated material (i.e. the reference target line). Therefore, the golfer will envision a target line that is the proper line of travel of the golf ball to the cup. The golfer can then look down at the golf ball and the putter head to prepare for the putting stroke. The elongated material is used as a reference so that the golfer is able to keep the head of the putter travelling along the proper target line, during the back swing, stroke, and follow-through. The elongated material is also used as a reference to help the golfer stroke the ball such that the face of the putter is square to the intended direction of travel.

FIG. 5 (a perspective view similar to FIG. 4), demonstrates an improper putting stroke. The golfer has addressed the proper target line and the golf ball such that his body has the proper stance, however, the golfer's eyes are not overtop of the proper target line and the golf ball. As may be seen in FIG. 5, the golfer's eyes are too far back from the elongated material (i.e. relative to the golfer). The golfer knows this because when he turns his eyes towards the base, he sees elongated material 30, and at the same time, he sees reflection 60 of the elongated material within the reflective material.

If the golfer remains in this position, then when he turns his eyes to look at the cup, he will envision a target line that is different from the proper target line. FIG. 5 shows how the golfer's imagined target line will cause him to stroke the golf ball in a manner that causes the golf ball to move along a path 76 that is different from the proper target line. Since the golfer does not have his eyes overtop of the proper target line, he is also not able to ensure that the head of the putter travels along the proper target line, during the back swing, stroke, and follow-through. Lastly, since the golfer's eyes are not overtop of the ball, he is not able to see that the face of the putter strikes the golf ball square to the intended direction of travel.

FIG. 6 (a perspective view similar to FIG. 4), also demonstrates an improper putting stroke. In this case, the golfer has positioned his eyes too far forward of the elongated material, (i.e. relative to the golfer). Once again, when the golfer turns his eyes towards the cup, he will envision a target line that is different from the proper target line. FIG. 6 shows how the golfer's imagined target line will cause him to stroke the golf ball in a manner that causes the golf ball to move along a path 78 that is different from the proper target line. As in the above case, since the golfer does not have his eyes overtop of the proper target line, he is not able to ensure that the head of the putter travels along the proper target line, during the back swing, stroke, and follow-through. Furthermore, as the golfer's eyes are not overtop of the ball, he is not able to see that the face of the putter strikes the golf ball square to the intended direction of travel.

By using my Golf Putting Vertical Alignment and Training Aid to learn how to address the proper target line and the golf ball, and to learn how to position one's eyes exactly overtop of the proper target line and the golf ball, one can learn how to achieve a putting stroke that is accurate and consistent. As the golfer becomes confident and proficient in these techniques, he or she will be able to accomplish the same without the use of the invention.

Operation of Invention—Breaking Putts

Once the golfer has reached this stage of operation, he or she will have used my invention to learn how to address the proper target line and the golf ball, to place his or her eyes exactly overtop of the proper target line and the golf ball, and to stroke the golf ball accurately and consistently. It is recommended that all of these techniques should first be practiced on a horizontal putting surface. As the golfer becomes more confident and skilled at putting the ball, the next stage is to practice the same techniques on uphill and downhill putting surfaces.

The last technique for the golfer to learn, is how to use my invention to improve the golfer's "breaking putts". A breaking putt is essentially a "straight putt" along the side of a hill or slope, except that the golf ball while travelling along the side of the hill is affected by gravity which pulls the golf ball downhill at the same time. In terms of the techniques that must be applied however, a breaking putt is the same as a straight putt. The golfer must address the proper target line and the golf ball, place his or her eyes exactly overtop of the proper target line and the golf ball, and stroke the ball in the manner described above.

The only difference as compared to a straight putt is that instead of aiming at the cup, the golfer must aim at an imaginary point that is uphill from the cup. The distance uphill from the cup that is aimed for, will depend upon the degree of angle of the slope or the steepness of the hill. In each case, the success of the breaking putt will be dependant upon the golfer's skill to judge the distance above the cup that the golf ball should be targeted towards. Once this point has been determined, then the golfer simply strokes the ball such that it travels towards the imaginary point. As the golf ball travels along its path it is then pulled by gravity downhill towards the cup.

The main point to understand about this explanation, is that a breaking putt is actually a straight putt that is performed along the side of a hill. As stated above however, the techniques in accomplishing the putt are the same. The only change is that the golfer must define a new target line that is now different than the previous proper target line that went from the golf ball to the cup. In this case, the new target line will be a straight line from the golf ball to the imaginary point that is up the hill from the cup. Once this new target line is determined, the golfer must then address the target line correctly and again place his or her eyes exactly overtop of the target line and the ball. The golfer must stroke the ball according to the instructions previously outlined.

The Golf Putting Vertical Alignment and Training Aid can be used to learn how to produce a proper and consistent stroke at the same time as learning how to become proficient with breaking putts. When using my invention to practice breaking putts, only minor changes need to be incorporated into the setup as compared to the horizontal, uphill, and downhill-putting-surface cases. First of all, the cup-end post must be placed at the point that the golfer wants to aim for (which will be uphill from the cup). Note that as stated above, the actual point to aim for to produce the desired results, will depend upon the physical conditions of the hill and the distance that the golf ball is from the cup. With continued practice, the golfer will become more skilled in choosing the right point.

In the meantime however, the invention will help the golfer to learn how to stroke the golf ball so that it travels towards the point that is chosen. Therefore, the cup-end post is first pushed into the putting surface at the point on the side of the hill that the golfer has chosen to aim for. The next step is to position the base at the general location where the golfer would like to practice the breaking putts. Recall, that once the base has been positioned, the golf ball can actually be moved along the target line to practice putts from different distances to the cup.

Once the base has been positioned and tension has been applied to the elongated material, the next step is to "level" the base. Recall that in the Theory of Operation sections, it was explained that the invention would not work if the base was positioned such that the left side of the base was facing downhill and the right side of the base was facing uphill (or visa versa). The theory that was provided above is still applicable, and therefore in order for the invention to function properly, the base must be put into a horizontal position. This can easily be accomplished by raising the side of the base that is facing downhill until the base becomes horizontal.

Therefore, if the left side of the base is facing downhill for example, the golfer can use a convenient object, such as a golf tee, to level the base. The golf tee (or two golf tees) can be pushed into the putting surface underneath the left side of the base to raise it up. The golfer need only look at the leveller to see how high the left side of the base needs to be raised. When the air bubble has again settled in the middle of the cylinder and between the black lines, then the base will be level. The golfer is then ready to practice his or her breaking putts. The operation of the invention at this point will then be the same as already described above.

Using this invention, the golfer can significantly improve his or her breaking putts. This is because the invention will help the golfer to maintain the proper techniques of putting the ball while learning how to determine the imaginary point to aim for in the breaking putt.

Operation of Invention—Instructor Feedback

One of the most unique qualities of my Golf Putting Vertical Alignment and Training Aid, is that it is the first invention to provide positive feedback to a golf instructor (or other person) as to whether the golfer is properly placing his or her eyes exactly overtop of the target line and the golf ball.

The first step is for the golfer to address the proper target line and place his or her eyes overtop of the proper target line and the golf ball. The golf instructor can then stand a distance from the back side of the base, facing towards the back side of the base and towards the golfer. The instructor must stand at a distance whereby he or she can see the elongated material and the reflection of the elongated material in the reflective material. The instructor must then close one eye prior to looking at the elongated material and the elongated material's reflection in the reflective material. (See the above section entitled "Theory Regarding Placement of the Head" for an explanation of why one eye must be closed when viewing the elongated material and the elongated material's reflection.)

The instructor can then line-up the elongated material so that it is exactly overtop of its reflection. This is done in the same way as previously described. The instructor simply moves his or her head to the left or right until the elongated material and the elongated material's reflection are seen to come together. Once the elongated material's reflection is hidden by the elongated material itself, it will mean that the instructor has positioned his or her eye exactly overtop of the target line. Now, without moving his or her eye, the instructor can continue to look at the reflective material to see the reflection of the golfer's eyes. If the golfer has correctly positioned his or her eyes, then the instructor will see the reflection of the golfer's eyes exactly along the target line within the reflective material. If the golfer's eyes are not on the proper target line, then the instructor will be able to tell the golfer whether he or she should move the eyes forwards or backwards (relative to the golfer).

By using my invention in this manner, the golfer can practice addressing the proper target line and the golf ball, and placing his or her eyes overtop of the target line and the golf ball, without first looking at the reflective material. The instructor can then check on the positioning of the golfer's eyes and provide feedback to the golfer on any corrections.

Conclusion, Ramifications, and Scope

Accordingly, the reader will see that my invention, being a golf putting vertical alignment and training aid, can be used to help a golfer learn how to accurately and consistently position his or her eyes vertically above the golf ball and the target line. Once the golfer has learned to position the eyes correctly, he or she can then learn how to perform a proper and consistent putting stroke.

This invention has numerous additional advantages in that:

- with the addition of a levelling means, as shown in the drawings, it can be set up on any putting surface, regardless of the slope or orientation of the putting surface;
- when using this invention, the golf ball can be placed on the actual surface that the golfer wishes to practice putting on, rather than having to place the golf ball within a mechanical apparatus;

when this invention is used to practice stroking a golf ball, the ball travels on the desired putting surface without any interference from any of the components of the invention;

with this invention, the golfer is able to perform a smooth natural putting stroke that is unobstructed by any of the components of the invention;

before the golfer even begins to practice the putting stroke, he or she can first set up this invention so that the elongated material presents an accurate reference target line from the golf ball to the cup;

the reference target line that is presented by this invention, is positioned above the actual putting surface so that it does not interfere with the golfer's stroke or the roll of the golf ball;

with the assistance of the levelling device that has been incorporated into a typical embodiment of this invention, the invention can be used to learn how to properly putt a golf ball on any putting surface, regardless of the orientation of such surface;

the elongated material of this invention that is used as the reference target line, can be made of a very small-diameter material which does not cause any distraction to the golfer when using the invention;

this invention can be made of small, light, and inexpensive materials that are easy to manufacture and which can be conveniently transported in the golfer's bag;

this invention is easy to assemble and disassemble, and takes up minimal storage space;

a golf instructor can use the vertical-aligning attributes of this invention to verify that a golfer has positioned his or her eyes properly overtop of the target line;

when a golfer uses this invention, the components of the invention do not interfere with the golfer's putter or with the golf ball;

with this invention, the golfer can learn how to envision the proper target line from the golf ball to the cup, which in turn will help the golfer to learn how to assume a balanced putting stance that is square to the target line;

with this invention, the golfer has an almost unobstructed view of the golf ball;

with this invention, the golfer can practice putting at different distances from the cup, without having to reposition the invention;

this invention can be used to develop all types of putts, including straight, breaking, uphill, downhill, or any combination of these;

when a golfer uses this invention to practice his or her putting stroke, they are provided with instant feedback on the result of any putt;

this invention can be used to develop all of the individual components of a proper putting stroke, such as addressing the target line and the golf ball, positioning the eyes vertically overtop of the target line and the golf ball, and developing a putting stroke that follows the target line and correctly strikes the ball;

after all of the individual components of a proper putting stroke have been mastered, this invention can be used to combine them all together to develop a putting stroke that takes all of the factors into consideration and helps the golfer to develop an accurate and consistent putt.

While the above description contains many specificities, these should not be construed as limitations on the scope of the invention, but rather as providing illustrations of some of the presently preferred embodiments of this invention. Many other variations are possible. For example, there does not have to be a base in the design. The invention will work equally as well if the reflective material is placed directly upon the putting surface, below the elongated material.

If the putting surface is orientated horizontally, then a levelling means is also not required. However, if a levelling means is desired so that the invention can be used on putting surfaces that are sloped, then such levelling means can be attached directly onto the reflecting surface of the reflective material. Here again, the base would not be required in this type of embodiment.

The main components that must always be present for this invention to function properly, are the reflective material comprising a reflecting surface, the elongated material, and the suspending means for positioning the elongated material above the reflecting surface in a manner such that a reflection of a portion of the elongated material can be seen within the reflecting surface. If these components are present, then the golfer will be able to utilize the reflection of the elongated material to position the golfer's eyes substantially vertically overtop of the elongated material. This in turn will assist the golfer in determining a point on the putting surface that is directly below the elongated material. Since the elongated material represents a reference target line from the golf ball to the cup, this invention essentially aids the golfer in positioning his or her eyes substantially vertically overtop of the target line and the golf ball.

Any components outside of the three main components listed above, are not necessary for the invention to work properly. Therefore, as stated above, a base is not really a required component of the invention; it is simply part of one of the preferred embodiments. If a base is not provided, then the posts could both have pointed ends, so that they can be pressed into the putting surface in a substantially upright position.

If a base is provided, it does not necessarily have to be placed on the putting surface. A different embodiment would be to build the base such that it is molded onto the base-end post, part way up the length of the post. The post could then be moved in different directions until the levelling device indicates that the base is in a substantially horizontal orientation.

An embodiment that would also be attractive would be to actually make the base and the reflective material out of the same material, so that there would only be one component instead of two separate components. This could be done by making the reflective material out of a highly-polished metallic material. Therefore the metal would provide a reflection of the elongated material and at the same time it would be strong enough to hold the base-end post in place.

Since the base is not an essential component of this invention, it does not matter what material the base is made of, as long as it satisfies the basic requirements of the particular embodiment that incorporates such base. For example it must be sturdy enough to support an upright post if such post is connected to the base. Furthermore, as described in the above detailed description of the invention, the size or shape of the base is not a critical factor, as long as such size and shape are designed to accommodate the main components of the invention.

There are also many flexibilities regarding the design of the reflective material. The only constraint is that it has a reflecting surface. Therefore, the reflective material could be a mirror, or it could be made of glass, metal, plastic, or any other material that has reflective qualities. It could even be a thick oily fluid that provides a reflection of an object above the fluid. In this type of embodiment, a levelling means would not be required because the surface of the oily fluid would naturally maintain a horizontal orientation.

The design of the elongated material is equally as flexible. It can have a rectangular cross-section such as with a long nylon tape, a circular cross-section such as with a long nylon cord, or any other type of cross-section. The main consideration is that it must be elongated so that it can be aligned above the target line from the golf ball to the cup. Note however, that it does not necessarily have to be of a length that goes from the golf ball all the way to the cup. One embodiment could consist of an elongated material of a shorter length that simply is pointed from the golf ball towards the cup.

The elongated material can also be made of basically any type of material. It could be made of a flexible material such as in the case of strings, ropes, cords, fibers, nylon, and wires. It could also be made of rigid materials such as in the case of plastics, wood, and metals. An important consideration in determining the composition of the elongated material is to make it with a small diameter so that it does not interfere with the functionality of the invention.

Lastly, there are many flexibilities regarding the design of the suspending means. It is important to note that the suspending means does not have to be two posts as shown in the drawings. There could be a number of posts holding up the elongated material. Or, if the elongated material was made of a rigid material, then a single post could be used to hold up the elongated material. In this type of embodiment, the post could be attached at one of the ends of the elongated material, or at any point along the length of the elongated material.

In a different embodiment, the suspending means could actually be composed of two rigid members at each end of the elongated material. The two rigid members could be connected to the elongated material in a variety of ways. In one embodiment, the two members could be connected at different points along the elongated material such that when they are pressed into the putting surface they are both substantially vertical. In a different embodiment, the two rigid members could be connected at the same point on the elongated material and then extended at different angles away from the elongated material. In this type of embodiment, one would see a triangle shape composed of the putting surface and the two members, when viewing the invention from an end perspective.

It is evident from the above descriptions, that there could be innumerable variations of the suspending means, all of which do not affect the main functioning of the invention. As long as the elongated material is suspended above the reflecting surface in a manner such that a reflection of a portion of the elongated material can be seen within the reflecting surface, it does not matter how the suspending means is accomplished.

As may be seen from all of the above descriptions, there are a very large number of embodiments that have not been shown in the drawings or described in detail. Therefore, the scope of my invention should be determined by the appended claims and their legal equivalents, rather than by the examples given.

It is also important to note that all of the above descriptions of operation of my invention have related to a golf putting vertical alignment and training aid. In actual fact, this invention could also be used in many other situations to obtain a vertical alignment. For example, in the construction industry it is often necessary to locate a line on the floor of a building, whereby such line is exactly vertically below a beam on the ceiling of the building. By looking into the reflecting surface of the reflective material of my invention, one could position the elongated material such that it follows the length of the beam in the ceiling. The human could then easily determine a line on the floor that is exactly vertically below the length of the beam, by following the procedure described above in the Operation of Invention sections.

I claim:

1. A golf putting vertical alignment and training aid, comprising:

(a) a reflective material comprising a reflecting surface, said reflective material adapted to be positioned remote from a golf ball, a golf putter club, and a golfer standing in a putting position, (b) an elongated material, said elongated material adapted to be positioned overtop of a target line in a manner such that when viewed from above, said elongated material's longitudinal axis appears to be parallel to said target line, said target line defined by the path that said golfer would like said golf ball to follow upon a putting surface and said elongated material being of a minimum length that extends from said golf ball to said reflective material, and (c) a suspending means for positioning said elongated material above said target line and said reflecting surface in a manner such that a reflection of a portion of said elongated material can be seen within said reflecting surface, whereby said reflection can be used by said golfer to position the golfer's eyes substantially overtop of said elongated material, therefore aiding the golfer in learning how to position the golfer's eyes overtop of said golf ball and overtop of said target line, which results in the golfer learning how to perform the putting stroke correctly.

2. The golf putting vertical alignment and training aid of claim 1 wherein:

(a) said reflecting surface is planar and said reflective material is comprised of a material selected from the group consisting of mirrors, fluids, metals, glass, and plastics, and (b) said elongated material is comprised of a material selected from the group consisting of strings, ropes, wires, plastics, fibers, nylon, wood, and metals.

3. The golf putting vertical alignment and training aid of claim 1 wherein said suspending means comprises a first post and a second post, said first post having a means for attaching one end of said elongated material to one end of said first post, and said second post having a means for attaching the other end of said elongated material to one end of said second post, and where said posts have a supporting means for holding said posts substantially upright such that the entire length of said elongated material is maintained above the surface that is between the posts.

4. The golf putting vertical alignment and training aid of claim 3, further including a base that comprises a means for holding the reflective material in place, and said base also providing said supporting means for holding either said first post or said second post, substantially upright.

5. The golf putting vertical alignment and training aid of claim 1 wherein said elongated material is constructed of a rigid material such that said suspending means is connected to said elongated material at only one end of the length of said elongated material and such that the entire length of said elongated material is maintained above the surface that said vertical alignment and training aid is placed upon.

6. The golf putting vertical alignment and training aid of claim 5 wherein said suspending means comprises a post, said post having a means for attaching one end of said elongated material to one end of said post, and further including a base that comprises a means for holding the reflective material in place, and said base also providing a supporting means for holding said post substantially upright.

7. The golf putting vertical alignment and training aid of claim 1, further including a levelling means for positioning said reflecting surface in a desired orientation.

8. The golf putting vertical alignment and training aid of claim 7 wherein said desired orientation of said reflecting surface is such that the axis of said reflecting surface that is transverse to the longitudinal direction of said elongated material, is in a substantially horizontal orientation.

9. A golf putting training aid, comprising:

(a) a reflective material comprising a reflecting surface, said reflective material adapted to be positioned at a stationary location remote from a golf ball, a golf putter club, and a golfer standing in a putting position, and said reflective material also adapted to be positioned such that if a target line was extended towards said reflective material, said target line would pass directly beneath a portion of said reflective material, said target line defined by the path from said golf ball to a golf cup remote from said golf ball, (b) an elongated material, said elongated material adapted to be positioned overtop of said target line in a manner such that when viewed from above, said elongated material's longitudinal axis appears to be parallel to said target line, and said elongated material being of a minimum length that extends from said golf ball to said reflective material, and (c) a suspending means for positioning said elongated material above said target line and said reflecting surface in a manner such that a reflection of a portion of said elongated material can be seen within said reflecting surface, whereby said reflection can be used by a golfer to position said golfer's eyes substantially overtop of said elongated material, therefore aiding the golfer in learning how to position the golfer's eyes overtop of said golf ball and overtop of said target line, which results in the golfer learning how to perform the putting stroke correctly so that said golf ball travels along said target line to said golf cup.

10. The golf putting training aid of claim 9, further including a levelling means for positioning said reflecting surface such that the axis of said reflecting surface that is transverse to the longitudinal direction of said elongated material, is in a substantially horizontal orientation.

11. The golf putting training aid of claim 10 wherein said levelling means comprises a hollow transparent cylinder that is partially filled with a fluid such that an air bubble can be seen by said golfer inside of said cylinder and further including a means for attaching said cylinder to said golf putting training aid in a manner such that the longitudinal axis of said cylinder is on the same horizontal plane or a parallel horizontal plane, as said reflecting surface, and in a manner such that the longitudinal axis of said cylinder is transverse to the longitudinal direction of said elongated material.

12. The golf putting training aid of claim 9 wherein:

(a) said reflecting surface is planar and said reflective material is comprised of a material selected from the group consisting of mirrors, fluids, metals, glass, and plastics, and (b) said elongated material is comprised of a material selected from the group consisting of strings, ropes, wires, plastics, fibers, nylon, wood, and metals.

13. The golf putting training aid of claim 9 wherein said suspending means comprises a first post and a second post, said first post having a means for attaching one end of said elongated material to one end of said first post, and said second post having a means for attaching the other end of said elongated material to one end of said second post, and where said posts have a supporting means for holding said posts substantially upright such that the entire length of said elongated material is maintained above said reflective material.

14. The golf putting training aid of claim 13, further including a base that comprises a means for holding the reflective material in place, and said base also providing said supporting means for holding either said first post or said second post, substantially upright.

15. A golf putting training aid, comprising:

(a) a reflective material comprising a reflecting surface, said reflective material adapted to be positioned at a stationary location remote from a golf ball, a golf putter club, and a golfer standing in a putting position, and said reflective material also adapted to be positioned such that if a target line was extended towards said reflective material, said target line would pass directly beneath a portion of said reflecting surface, said target line defined by the path from said golf ball to a golf cup remote from said golf ball, (b) an elongated material, said elongated material adapted to be positioned overtop of said target line in a manner such that when viewed from above, said elongated material's longitudinal axis appears to be parallel to said target line, and said elongated material being of a minimum length that extends from said golf cup, overtop of said golf ball, to said reflective material, (c) a first post and a second post, said first post having a means for attaching one end of said elongated material to one end of said first post, and said second post having a means for attaching the other end of said elongated material to one end of said second post, and where said posts have a supporting means for holding said posts substantially upright such that the entire length of said elongated material is maintained above a golfing surface that said reflective material is positioned upon and in a manner such that a reflection of a portion of said elongated material can be seen within said reflecting surface, and (d) a base that comprises a means for holding said reflective material in place, and said base also providing said supporting means for holding either said first post or said second post, substantially upright, whereby said reflection can be used by a golfer to position said golfer's eyes substantially overtop of said elongated material, therefore aiding the golfer in learning how to position the golfer's eyes overtop of said golf ball and overtop of said golf cup, which results in the golfer learning how to perform the putting stroke correctly so that said golf ball travels along said target line to said golf cup.

16. The golf putting training aid of claim 15, further including a levelling means for positioning said reflecting surface such that the axis of said reflecting surface that is transverse to the longitudinal direction of said elongated material, is in a substantially horizontal orientation.

* * * * *